US008494387B2

(12) United States Patent
Kawamura

(10) Patent No.: US 8,494,387 B2
(45) Date of Patent: Jul. 23, 2013

(54) COLOR-IMAGE FORMING APPARATUS

(75) Inventor: Hiroshi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 441 days.

(21) Appl. No.: 12/472,191

(22) Filed: May 26, 2009

(65) Prior Publication Data

US 2009/0297222 A1 Dec. 3, 2009

(30) Foreign Application Priority Data

May 27, 2008 (JP) ..... 2008-138047
Apr. 15, 2009 (JP) ..... 2009-099066

(51) Int. Cl.
*G03G 15/16* (2006.01)

(52) U.S. Cl.
USPC ..... 399/66; 399/36; 399/300

(58) Field of Classification Search
USPC ..... 399/9, 36, 38, 66, 75, 167, 297–302, 399/306, 308
See application file for complete search history.

(56) References Cited

U.S. PATENT DOCUMENTS

| | | | | |
|---|---|---|---|---|
| 5,072,244 | A | 12/1991 | Aoki | |
| 6,724,161 | B2 * | 4/2004 | Ueda et al. | 318/34 |
| 8,150,281 | B2 * | 4/2012 | Kawaguchi et al. | 399/49 |
| 2001/0008589 | A1 * | 7/2001 | Sasame et al. | 399/167 |
| 2003/0063928 | A1 * | 4/2003 | Matsuguma | 399/299 |
| 2012/0155904 | A1 * | 6/2012 | Kawaguchi et al. | 399/66 |

FOREIGN PATENT DOCUMENTS

JP 01-142567 6/1989

* cited by examiner

*Primary Examiner* — Walter L Lindsay, Jr.
*Assistant Examiner* — Benjamin Schmitt
(74) *Attorney, Agent, or Firm* — Canon USA Inc IP Division

(57) ABSTRACT

A color-image forming apparatus includes a plurality of photosensitive members corresponding to individual colors and disposed along the moving direction of a transfer member to which toner images are to be transferred, wherein the peripheral speed of a photosensitive member that is not forming a toner image on the transfer member is controlled so that a load during forming of a toner image on the transfer member with part of the photosensitive members at least comes close to a reference load generated between all the photosensitive members and the transfer member while all the photosensitive members are forming toner images on the transfer member.

20 Claims, 20 Drawing Sheets

COLOR-IMAGE FORMING APPARATUS

BACKGROUND OF THE INVENTION

1. Field of the Invention

The present invention relates to a technique for preventing color misalignment in a color-image forming apparatus.

2. Description of the Related Art

In recent years, color-image forming apparatuses that adopt electrophotography, such as color printers and color copying machines have been required to output high-quality images.

As factors for determining the quality of an output image, there are misalignment of an image-writing position on a recording medium, recording accuracy typified by image expansion/contraction, and color misalignment, that is, the overlaying accuracy of color toner images which influences on the color of the image.

In particular, with the electrophotographic color-image forming apparatuses, degradation of recording accuracy and changes in color due to color misalignment are caused by environmental changes or variable factors of device components due to long use, thus degrading the quality of output images.

An example of the causes of such changes, for example, in an image forming apparatus that adopts an intermediate transfer belt as an endless belt, is speed fluctuations of the intermediate transfer belt.

Thus, for example, a method disclosed in Japanese Patent Application Laid-Open No. 01-142567 is used. Specifically, color toner patches are formed on an intermediate transfer belt, the positions of the toner patches are detected by a registration sensor, and the time at which the color-toner images are written to the intermediate transfer belt is changed using the detection results, thereby preventing color misalignment. Here, the toner patches are unfixed toner images for detecting color misalignment.

However, even if the known color misalignment correction using the registration sensor is executed, color misalignment occurs when the color toner images are actually transferred to a recording medium after the correction.

This is because the peripheral speed of the intermediate transfer belt when the positions of the toner patches on the intermediate transfer belt are detected by the registration sensor and the peripheral speed of the belt during actual-image formation differ. Here, generation of the difference in the peripheral speed of the intermediate transfer belt will be described in an orderly manner.

FIG. 11 is a diagram showing the state of a load applied on an intermediate transfer belt unit of a tandem-type color-image forming apparatus using a general intermediate transfer belt 30. In FIG. 11, to improve the transfer accuracy, the peripheral speed Vb of the intermediate transfer belt 30 is set about 0.5% or below higher than the peripheral speed Vd of photosensitive drums 26.

A belt driving torque T at that time is expressed by the following Eq. (1):

$$T=Tb+\mu F\times 4 \qquad \text{Eq. (1)}$$

where Tb is a torque that moves only the intermediate transfer belt 30 and μF is a frictional force that is generated due to the contact of the intermediate transfer belt 30 and the drums 26, where μ is the friction coefficient between the belt 30 and the drums 26, and F is a transfer pressure. Here, the contact means a state in which the intermediate transfer belt 30 and the photosensitive drums 26 are in contact to generate pressure, irrespective of the presence of a toner layer between the intermediate transfer belt 30 and photosensitive drums 26.

Next, as shown in FIG. 12, the belt driving torque T in which the drum peripheral speed Vd is intentionally set higher than the belt peripheral speed Vb is expressed by the following Eq. (2), and the belt driving torque T is decreased because the belt 30 is wound around the photosensitive drums 26.

$$T=Tb-\mu F\times 4 \qquad \text{Eq. (2)}$$

Here, changes in torque after the belt 30 is driven from its halted state until it is halted again through image formation will be described with reference to Eq. (1).

First, when the friction coefficient μ between the belt 30 and the drums 26 is defined as the following two, changes in the torque T after the belt 30 is driven from its halted state until it is halted again through image formation are expressed by the following Eqs. (3) to (7). Changes in load torque applied on the belt 30 are shown in FIGS. 13 to 20.

In the drawings, reference numeral 26 denotes photosensitive drums, numeral 54 denotes developing rollers, numeral 52 denotes primary transfer rollers, and numeral 30 denotes an intermediate transfer belt. Reference character Y indicates yellow, character M indicates magenta, character C indicates cyan, and character Bk indicates black. Here, the friction coefficient μ between the belt and the drum is defined as the following two: a friction coefficient μ1 when there is no toner between the belt and the drum; and a friction coefficient μ2 when there is toner between the belt and the drum.

$$T=Tb+\mu 1F\times 4 \qquad \text{Eq. (3) (see FIG. 13)}$$

$$T=Tb+(\mu 1F\times 3+\mu 2F) \qquad \text{Eq. (4) (see FIG. 14)}$$

$$T=Tb+(\mu 1F\times 2+\mu 2F\times 2) \qquad \text{Eq. (5) (see FIG. 15)}$$

$$T=Tb+(\mu 1F+\mu 2F\times 3) \qquad \text{Eq. (6) (see FIG. 16)}$$

$$T=Tb+\mu 2F\times 4 \qquad \text{Eq. (7) (see FIG. 17)}$$

Hereinafter, see Eq. (6) (see FIG. 18)→Eq. (5) (see FIG. 19)→Eq. (4) (see FIG. 20)→Eq. (3) (see FIG. 13).

The two friction coefficients μ1 and μ2 generally have a relationship, μ1>μ2. The load (torque) applied to the belt is decreased when the developing roller 54 comes into contact therewith and is increased when the developing roller 54 comes out of contact therewith.

The mechanism of decreasing the load will be described in more detail. For example, FIG. 14 shows a state in which a developing roller 54Y is in contact with a photosensitive drum 26Y. At the point in time in FIG. 14, the toner on the developing roller 54Y adheres to the photosensitive drum 26Y as fogged toner, and thereafter, the fogged toner reaches a primary-transfer nip portion between the photosensitive drum 26Y and the intermediate transfer belt 30. Then, the load applied on the belt 30 due to the contact of the developing roller 54 is decreased owing to the action of the toner, so that the load on the entire belt is also decreased. As the process moves from FIG. 15 to FIG. 17, the total amount of the fogged toner that reaches the primary-transfer nip portion increases, and the load on the belt 30 decreases. On the other hand, as the process moves from FIG. 18 to FIG. 20, the developing rollers 54 are separated, and the fogged toner at the primary-transfer nip portion decreases, and, in contrast, the load on the intermediate transfer belt increases.

Next, with reference to the above description, a case in which toner patches are detected by the registration sensor will be described. A belt driving torque when toner patches on the belt 30 are detected by the registration sensor is constant in the state in Eq. (7), and the peripheral speed of the belt 30 is also constant. On the other hand, as has been described with reference to the foregoing Eqs. (3) to (7) and FIGS. 14 to 20, this state is different from a torque generation state (load generation state) directly after the start of image formation and directly before the completion of image formation.

On the other hand, it is known that the belt-drive transmission system constituted of a gear train for driving a belt is elastically deformed in proportion to stress generated from its load torque, as expressed by Hooke's law. Elastic deformation according to the generation of the load temporarily changes the transmission speed of the drive transmission system. In other words, it temporarily changes the peripheral speed of the belt. More specifically, the elastic deformation also has continuity, and therefore, also the position of the belt temporarily changes gradually due to the continuous elastic deformation. The temporary positional change of the belt causes fluctuations in the belt peripheral speed.

That is, the belt peripheral speed changes when the individual states in Eqs. (3) to (7) shift to the next states. For example, when the load torque applied on the belt changes from small to large, the belt peripheral speed slows down, and in contrast, when it changes from large to small, the belt peripheral speed increases. The fluctuations in belt peripheral speed here can also be regarded as following changes in belt position and can also be considered as changes in belt position due to temporary load fluctuations.

Even if toner patches on the belt are detected by the registration sensor, with no fluctuations in belt peripheral speed, and correction is made on the basis of the result, color misalignment (transfer position displacement) will occur because the belt peripheral speed fluctuates during actual image formation.

To eliminate the fluctuations in belt speed, there are the following three typical methods: first, eliminating elastic deformation of the belt-drive transmission system by increasing the rigidity thereof; secondly, eliminating fluctuations of the friction coefficient $\mu$ between the belt and the drum; and thirdly, executing image formation after the state of Eq. (7) has been achieved.

The first method will be described. In general, increasing the rigidity of the belt-drive transmission system can reduce the elastic deformation described above. For example, if the material of gears, which are elements of the drive transmission system, is changed from resin, such as polyacetal, to metal, such as brass, the rigidity can be increased. It has been confirmed by our experiment that speed fluctuations can be improved by increasing the rigidity using metal gears.

However, the metal gears have excessively high rigidity, which causes vibrations due to engagement, thus posing the adverse effect of applying the vibrations to an image. Moreover, since the metal gears are formed by cutting, the cost thereof is considerably higher than that of resin gears formed by injection molding, so that they are not practical.

The second method will be described. Theoretically, setting the friction coefficients $\mu 1$ and $\mu 2$ equal can reduce fluctuations of the friction coefficient $\mu$. However, the surface layers of the present photosensitive drums are so smooth that they are prone to adhere to the belt, thus causing a significantly large frictional force. Although microscopic unevenness may be provided on the surfaces of the photosensitive drums to decrease contact areas, degradation of image quality can occur, so that it is not practical. Moreover, fluctuations in friction cannot be made zero because there is an attraction force due to transfer bias, in addition to the presence/absence of toner.

The third method will be described. The third method is technically feasible by turning ON/OFF the charging, developing, and transfer processes of the image-formation processing unit, which are the causes of generating load fluctuations, except when transferring a visible image from the photosensitive drums to the intermediate belt.

However, although this provides a high-quality image in which color misalignment is reduced, the ON/OFF of the charging, developing, and transfer processes of the processing unit is performed except when transferring a visible image from the photosensitive drums to the intermediate belt. This increases the processing time, such as charging and developing, thus decreasing the productivity of the apparatus. In other words, this has the problem of decreasing the life of the processing unit. In particular, when frequently printing a small number of pages, the influence is negligible. That is, this not only causes the user to frequently replace the processing unit but also increases its running cost.

SUMMARY OF THE INVENTION

According to an aspect of the present invention, a color-image forming apparatus includes a plurality of photosensitive members corresponding to individual colors and disposed along the moving direction of a transfer member to which images are to be transferred (hereinafter simply referred to as a transfer member), in which the individual photosensitive members are brought into contact with the transfer member so that toner images are transferred to the transfer member in sequence, thereby performing image formation of an input job. The color-image forming apparatus includes a control unit configured to control the peripheral speed of a photosensitive member, which is not forming a toner image on the transfer member, so that a load during forming of a toner image on the transfer member with part of the photosensitive members at least comes close to a reference load generated between all the photosensitive members and the transfer member while all the photosensitive members are forming toner images on the transfer member.

Further features and aspects of the present invention will become apparent from the following detailed description of exemplary embodiments with reference to the attached drawings.

DESCRIPTION OF THE EMBODIMENTS

Exemplary embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments.

Figure 1:
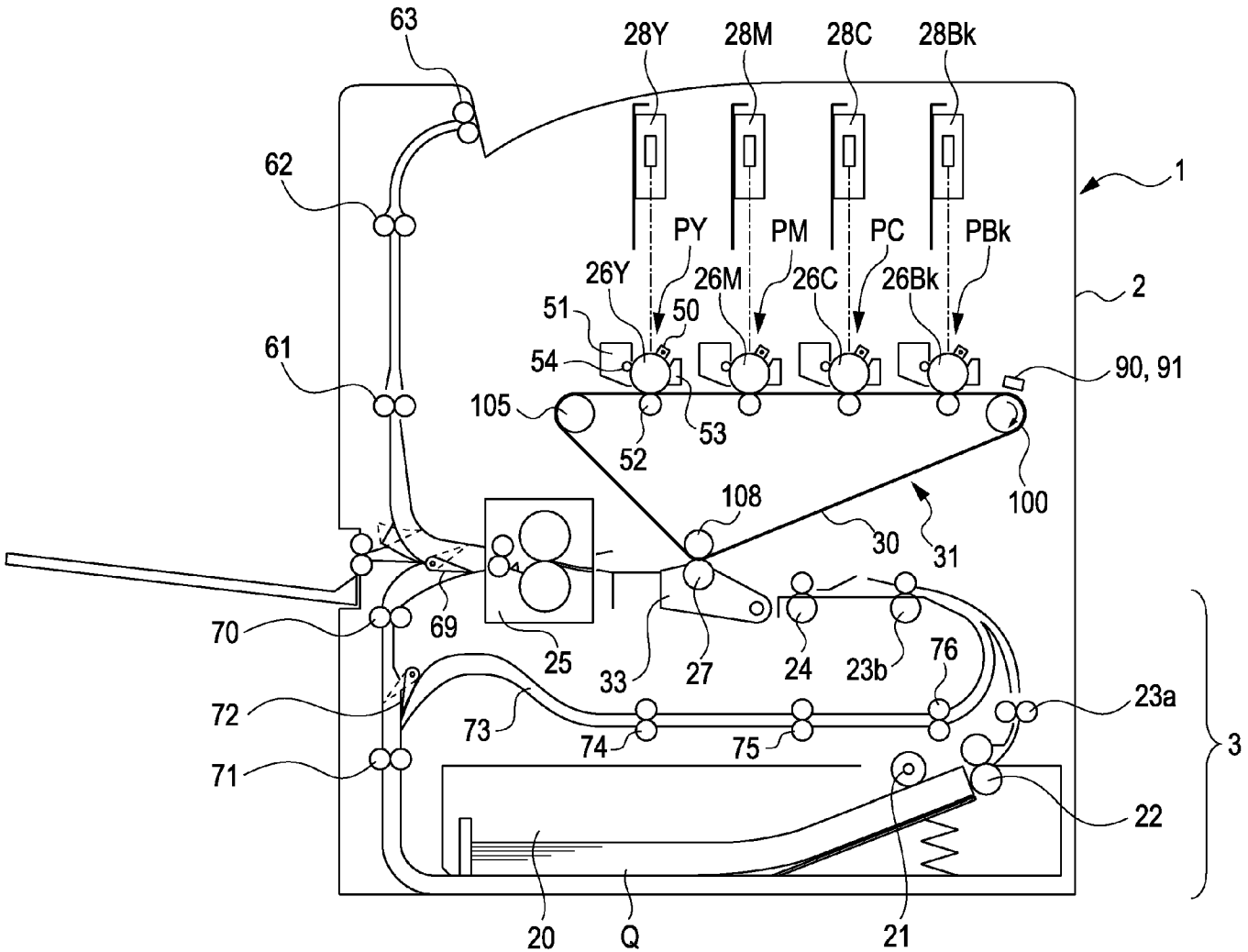
FIG. 1 is a cross-sectional view showing the schematic configuration of a four-drum full-color-image forming apparatus using an intermediate transfer belt.

An image forming apparatus according to a first embodiment will be described. Here, as an example of the image forming apparatus that employs an electrophotographic system, a four-drum full-color-image forming apparatus using an intermediate transfer belt is shown. FIG. 1 is a schematic cross-sectional view showing the configuration, in outline, of a four-drum full-color-image forming apparatus using an intermediate transfer belt.

Overall Configuration of Image Forming Apparatus

As shown in FIG. 1, a four-drum full-color-image forming apparatus 1 is configured such that process cartridges P, such as PY, PM, PC, and PBk, in four colors, that is, yellow, magenta, cyan, and black, are detachably mounted to an image-forming-apparatus main body (hereinafter referred to as a main body) 2. The main body 2 is provided with an intermediate transfer belt unit 31 having an intermediate transfer belt 30, which is an intermediate transfer member (rotational body), and a fixing unit 25.

Here, the individual process cartridges P have memory tags (not shown) and are configured to determine the remaining lives and the replacement conditions thereof through communication with the main body 2.

The individual process cartridges P have photosensitive drums 26Y, 26M, 26C, and 26Bk, which are image bearing members (photosensitive members), and are arranged along the moving direction of the intermediate transfer belt 30, which is a transfer member to which images are to be transferred. The photosensitive drum 26Y corresponds to the uppermost stream photosensitive drum, and the photosensitive drum 26Bk corresponds to the lowermost stream photosensitive drum in the moving direction of the transfer member. Each of the process cartridges P integrally includes a primary charger 50 serving as a charging member, a developing unit 51 serving as a developing member, and a cleaner 53 serving as a cleaning member around the individual photosensitive drums 26. The process cartridges P are arranged in parallel along the intermediate transfer belt 30.

In each of the process cartridges P, the primary charger 50 is disposed on the outer circumference of the photosensitive drum 26 and uniformly charges the surface of the photosensitive drum 26. The developing units 51 develop electrostatic latent color images formed on the surfaces of the individual photosensitive drums 26 with laser beams from laser exposure units (exposure units) 28Y, 28M, 28C, and 28Bk using toners of corresponding colors (yellow, magenta, cyan, and black). The developing roller 54 in the developing unit 51 is configured to prevent degradation of developer by moving out of contact with the photosensitive drum 26 to stop the rotation together with the developing unit 51. That is, the developing roller 54 can come into and out of contact with the photosensitive drum 26 together with the developing unit 51. After toner images are transferred in sequence, the cleaners 53 remove the remainder of the transfer toner adhering to the surfaces of the photosensitive drums 26.

A primary transfer roller 52 that forms a primary transfer unit together with the photosensitive drum 26 is disposed at a position where it clamps the intermediate transfer belt 30 with the photosensitive drum 26.

On the other hand, the intermediate transfer belt unit 31 includes the intermediate transfer belt 30 and three rollers, that is, a driving roller 100, a tension roller 105, and a secondary-transfer counter roller 108, which stretch the intermediate transfer belt 30. The intermediate transfer belt 30 is rotationally run by rotationally driving the driving roller 100 with a belt drive motor (not shown).

The tension roller 105 is configured to be able to move horizontally in FIG. 1 in accordance with the length of the intermediate transfer belt 30.

Furthermore, two registration sensors 90 for detecting toner patches on the intermediate transfer belt 30 are provided in the vicinity of both ends of the driving roller 100 in the longitudinal direction. The longitudinal direction is the axial direction of the tension roller 105 and the widthwise direction perpendicular to the belt running direction.

Furthermore, a secondary transfer roller 27 that forms a secondary transfer unit together with the secondary-transfer counter roller 108 is disposed at a position where it clamps the intermediate transfer belt 30 with the secondary-transfer counter roller 108. The secondary transfer roller 27 is held by a transfer conveying unit 33.

A feeding unit 3 that feeds a recoding medium Q to a secondary transfer unit is disposed below the main body 2. The feeding unit 3 includes a cassette 20 accommodating a plurality of the recoding mediums Q, a feeding roller 21, a retarding roller pair 22 for preventing double feeding, conveying roller pairs 23*a* and 23*b*, a registration roller pair 24, etc.

Discharge roller pairs 61, 62, and 63 are provided along the conveying path downstream of the fixing unit 25.

Furthermore, the color-image forming apparatus 1 is configured for duplex printing, in which the recoding medium Q whose first surface is subjected to image formation is discharged from the fixing unit 25 and is conveyed toward reversing roller pairs 70 and 71 by switching a switching member 69. After the rear end of the recoding medium Q passes through a switching member 72, the switching member 72 is switched, and at the same time, the reversing roller pair 71 is reversed to introduce the recoding medium Q to a duplex conveying path 73.

Then, duplex-conveying-path roller pairs 74, 75, and 76 are rotationally driven to feed the recoding medium Q again, thereby allowing printing of the second surface.

Block Diagram of Image Forming Apparatus

Figure 2:
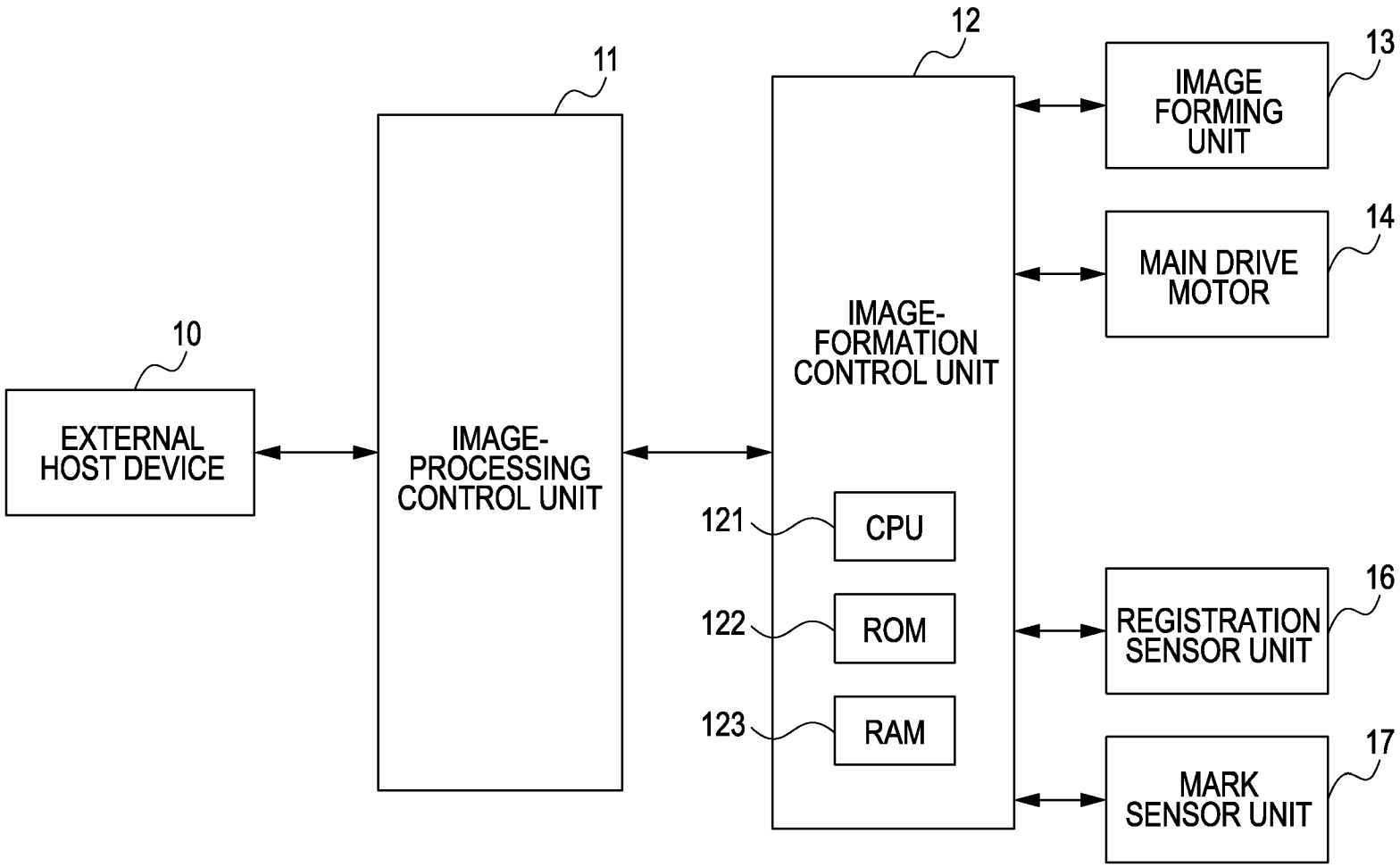
FIG. 2 is a block diagram showing the schematic configuration of the image forming apparatus.

Referring next to FIG. 2, the control configuration of the image forming apparatus 1 will be described. FIG. 2 is a block diagram showing the control configuration of the image forming apparatus 1.

The main body 2 shown in FIG. 1 receives a job from an external host device 10, such as a personal computer, connected to the main body 2 so as to communicate therewith. The main body 2 also receives RGB image signals from a document reader (not shown) that the main body 2 includes separately.

An image-processing control unit (control unit) 11 converts received and input data to CMYK signals, makes corrections of the gray level and density, and thereafter generates an exposure signal for the laser exposure units 28 (28Y, 28M, 28C, 28Bk). An image-formation control unit 12 controls the overall image forming operation, described below and controls the main body 2 during correction in the image-forming operation using the registration sensors 90 serving as patch detectors and a mark sensor 91 serving as a mark detector.

The image-formation control unit 12 includes a CPU 121 that controls processing by the image-formation control unit 12, a ROM 122 that stores programs etc. executed by the CPU 121, and a RAM 123 that stores various data during control operations by the CPU 121.

As shown in FIG. 1, an image forming unit 13 includes a plurality of (in this case, four) photosensitive drums 26 and charging members, developing members, cleaning members, and exposing members that act on the drums 26, which are provided in the rotating direction of the intermediate transfer belt 30.

A main drive motor 14 is a driving unit for rotationally driving the intermediate transfer belt 30 and all the photosensitive drums 26 at a predetermined speed in accordance with an instruction of the image-formation control unit 12.

A registration sensor unit 16 detects toner patches on the intermediate transfer belt 30 using the registration sensors 90.

A mark sensor unit 17 detects a position indicating mark provided on the intermediate transfer belt 30 using the mark sensor 91.

Image Forming Operation

Referring to FIG. 1, the image forming operation of the thus-configured four-drum full-color-image forming apparatus 1 will be described. The image forming apparatus 1 can form an image with toners of a plurality of colors (here, four colors) on a recoding medium.

When the image forming operation is started, the recoding mediums Q in a cassette 20 are fed by the feeding roller 21, are thereafter separated into individual sheets by the retarding roller pair 22, and are then conveyed to the registration roller pair 24 through the conveying roller pairs 23*a* and 23*b* etc. Here, at that time, the rotation of the registration roller pair 24 is halted, and the recording mediums Q abut against the nip of the registration roller pair 24, so that the skewing of the recoding mediums Q is corrected.

On the other hand, in parallel with the conveying operation for the recoding mediums Q, for example, in the yellow process cartridge PY, first, the surface of the photosensitive drum 26Y is uniformly negatively charged by the primary charger 50 and is then exposed to light by the laser exposure unit 28Y. Thus, an electrostatic latent image corresponding to a yellow image component of image signals is formed on the surface of the photosensitive drum 26Y.

Next, the developing roller 54 in the developing unit 51 comes into contact with the photosensitive drum 26Y while being rotationally driven, and the electrostatic latent image is developed by the developing unit 51 using the negatively charged yellow toner to be visualized as a yellow toner image. Thus-obtained yellow toner image is primarily transferred onto the intermediate transfer belt 30 by the primary transfer roller 52 to which bias voltage is supplied. At that time, the intermediate transfer belt 30 and the photosensitive drum 26 are in contact. The contact here indicates that the intermediate transfer belt 30 and the photosensitive drum 26Y are in contact to generate pressure irrespective of the presence/absence of a toner layer between the intermediate transfer belt 30 and the photosensitive drum 26*y*.

After the toner image is transferred, remaining toner that adheres to the surface of the photosensitive drum 26Y is removed by the cleaner 53.

Such a series of toner-image forming operations is also performed in sequence at a predetermined timing for the other process cartridges PM, PC, and PBk. The developing rollers 54 come into contact with the photosensitive drums 26 in sequence while rotating in order to prevent the degradation of the developer even if the upstream process cartridge is performing primary transfer directly before the image forming operation is started. Color toner images formed on the individual photosensitive drums 26 are primarily transferred in layers in sequence on the intermediate transfer belt 30 at the individual primary transfer unit. After completion of the developing operation, the developing rollers 54 are separated from the photosensitive drums 26 in sequence, and the rotation thereof is stopped in order to prevent the degradation of the developer even if the downstream process cartridge is performing primary transfer.

Next, the four-color toner image that is transferred in layers on the intermediate transfer belt 30 in this way is moved to the secondary transfer unit with the rotation of intermediate transfer belt 30 in the direction of the arrow.

Furthermore, the recoding mediums Q whose skewing is corrected by the registration roller pair 24 are fed to the secondary transfer unit in timing with the image on the intermediate transfer belt 30.

Thereafter, the four-color toner image on the intermediate transfer belt 30 is secondarily transferred onto the recoding mediums Q by the secondary transfer roller 27 that is in contact with the intermediate transfer belt 30 with the recoding mediums Q therebetween. The recoding mediums Q on which the toner image is transferred are conveyed to the fixing unit 25, where the toner image is fixed by application of heat and pressure, and are thereafter output and stacked on the upper surface of the main body 2 by the discharge roller pairs 61, 62, and 63.

The remaining toner on the surface of intermediate transfer belt 30 in which the secondary transfer is completed is removed by a belt cleaner (not shown) disposed in the vicinity of the tension roller 105.

Load Fluctuations Under No Control

Next, fluctuations in an intermediate-transfer-belt driving torque T when the peripheral speed Vd of the photosensitive drums 26 and the peripheral speed Vb of the intermediate transfer belt 30 are the same will be described. In the description below, the photosensitive drums 26 are sometimes simply referred to as drums, and the intermediate transfer belt 30 is sometimes simply referred to as a belt.

The relationship between the difference between the drum peripheral speed and the belt peripheral speed and the belt driving torque will be described in detail using the results of validation of measurements of an actual image forming apparatus.

Figure 3:
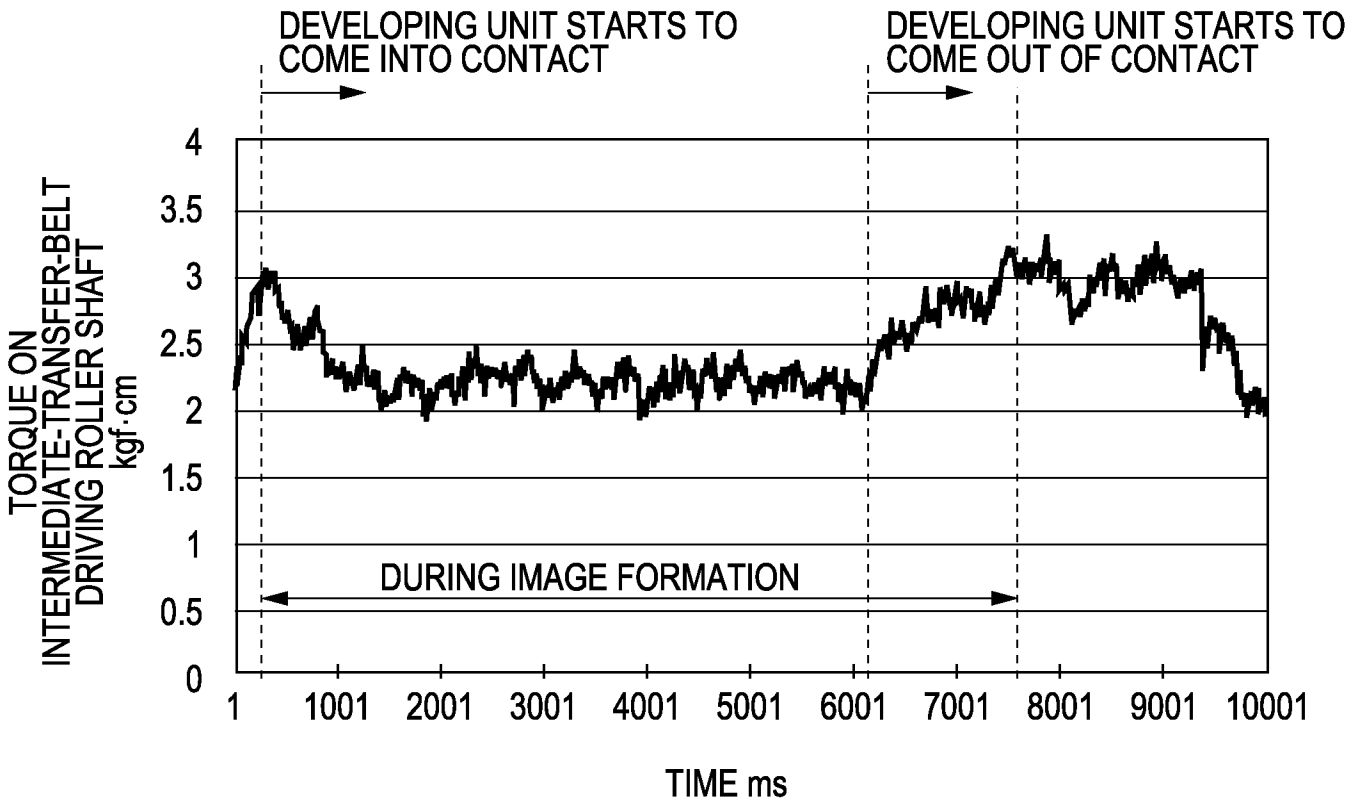
FIG. 3 is a diagram showing torque fluctuations of a driving roller of the intermediate transfer belt during an image forming operation.

In the above-configured image forming apparatus, the results of measurement of fluctuations in the rotation torque of the driving roller 100 when three sheets of LTR paper are continuously printed are shown in FIG. 3.

In the measurement, a peripheral speed difference is intentionally generated between the intermediate transfer belt 30 and the photosensitive drums 26 by changing the steady rotational speed of the photosensitive drums 26.

As shown in FIG. 3, in the case where there is a peripheral speed difference between the photosensitive drums 26 and the intermediate transfer belt 30, transient torque fluctuations (load fluctuations) occur at the beginning and the end of image formation. These torque fluctuations (load fluctuations) are caused by a frictional force generated due to the contact between the intermediate transfer belt 30 and the photosensitive drums 26, as described above.

Specifically, the torque fluctuations begin when the developing unit 51 comes into contact with the yellow photosensitive drum 26Y while the developing roller 54 in the developing unit 51 is being rotationally driven, and when fogged toner enters the primary-transfer nip portion. When the downstream developing rollers 54 come into contact with the photosensitive drums 26 in sequence, the torque decreases gradually and settles at some point in time. When the developing units 51 of the individual colors come into contact with their corresponding photosensitive drums one by one, the torque decreases continuously, not step by step. When the primary transfer of the upstream yellow color is completed and the developing roller 54 is separated from the photosensitive drum 26Y, so that fogged toner no longer enter the primary-transfer nip portion between the photosensitive drum 26Y and the intermediate transfer belt 30, the torque increases again. For the other colors, the torques increase gradually as the developing units are separated.

Here, the torque fluctuations will be described in more detail. In this embodiment, there is a relation, photosensitive drum speed<intermediate transfer belt speed, and when the contact of the developing unit 51 is started, the intermediate-transfer-belt driving torque decreases. It was confirmed that after the developing units 51 come into contact, fogged color toners reach the primary-transfer nip portions one by one, and the frictional force between the drums and the belt decreases, so that a reaction force from the drums, which applies load on the belt, is decreased.

Furthermore, it was confirmed that the presence/absence of toner at the nip portions between the photosensitive drums and the intermediate transfer belt depends not only on image forming toner applied at actual latent image formation but also on the contact/separation of the developing rollers 54 of the developing units 51. Furthermore, it was confirmed that load fluctuations generated at the primary-transfer unit due to arrival of fogged toner to the primary transfer nip portions does not cause further fluctuations due to arrival of image forming toner during latent image formation. That is, arrival of toner, irrespective of whether fogged toner or latent-image forming toner, to the primary transfer unit reduces a given load as compared with a case in which no toner reaches.

On the other hand, when the developing units 51 begin to separate as the primary transfer is completed from the upstream yellow toner at the end of the image formation, the supply of toner to the primary-transfer nip portion decreases. Therefore, the drums begin to apply loads on the belt, thus increasing the belt driving torque. (Results of measurement of color misalignment under no control)

Figure 4:
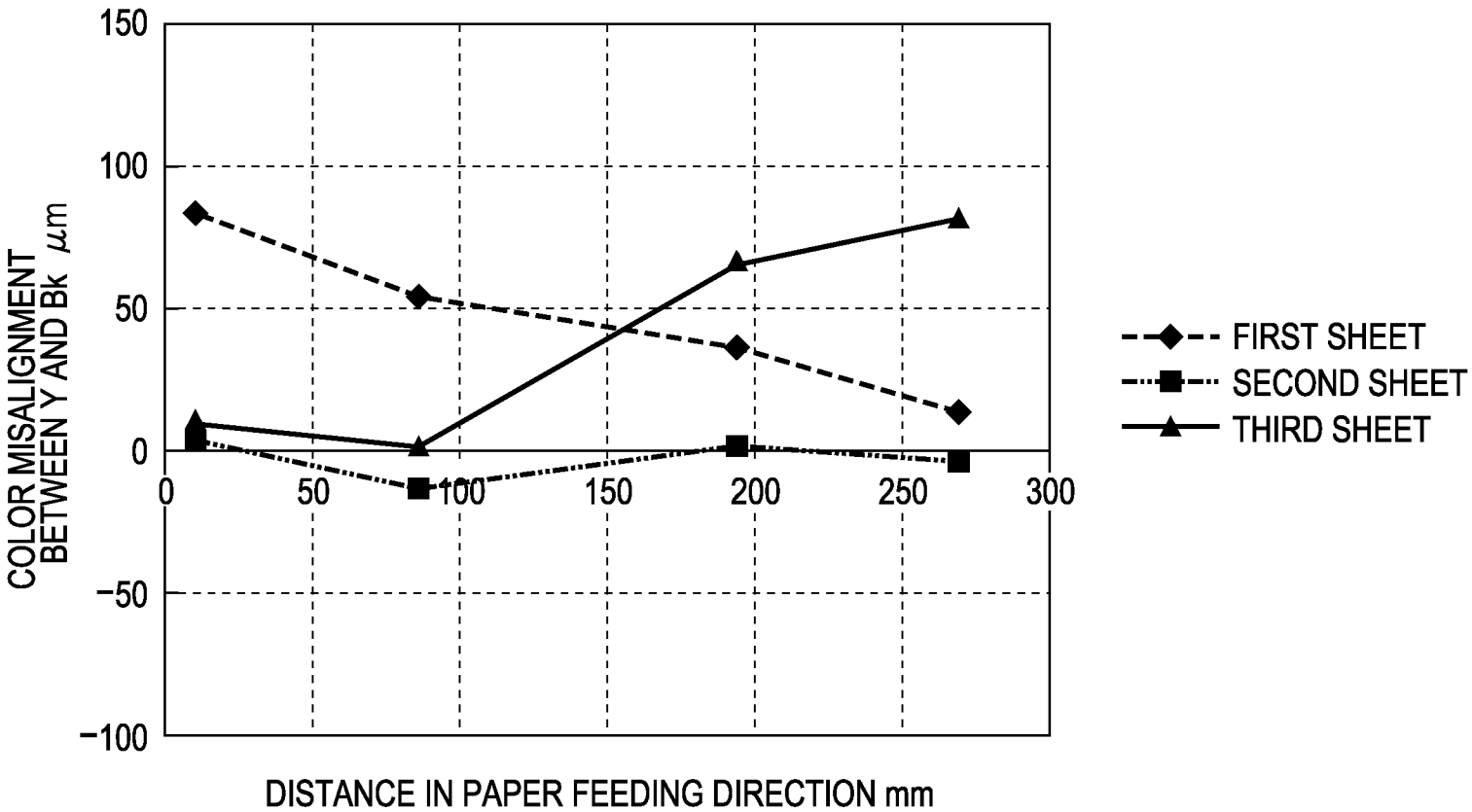
FIG. 4 is a diagram showing color misalignment behavior on an output image.

FIG. 4 shows the results of measurement of color misalignment, which is displacement of yellow relative to black on the recording medium, when three sheets of LTR paper are continuously output in a state in which there is a relation of peripheral speed difference, photosensitive drum speed<intermediate transfer belt speed.

Here, the horizontal axis shows a distance from the leading end of the recording medium to the trailing end in the moving direction when a toner image is transferred, where the leading end is set at zero. That is, it shows the distance from the leading end of LTR paper in portrait format to the trailing end. In the drawing, this is referred to as "distance in paper feeding direction". On the other hand, the vertical axis shows that a case in which yellow shifts to the trailing end of the paper with respect to black on the image is positive. The reason why attention is given on the color misalignment between black and yellow is that the color misalignment taken here occurs significantly between yellow, the first color in order of transfer, and black, the last color.

Referring to the measurement of the first page in FIG. 4, color misalignment occurs around 0 to 250 mm in the paper feeding direction, and at the latter half behind 100 mm for the third sheet in the paper feeding direction, color misalignment occurs in the direction opposite to the first sheet.

The color misalignment of the first sheet is due to the fact that the belt speed during the primary transfer of yellow, which is the first color in transfer order, gradually increases as the belt driving torque is decreased with the start of contact of the developing units 51, shown in FIG. 3. On the other hand, the color misalignment of the third sheet is due to the fact that the belt speed during the primary transfer of black, which is the last color, gradually decreases as the belt driving torque is increased with the start of separation of the developing units 51, as shown in FIG. 3.

For the second sheet that is subjected to the primary transfer with no torque fluctuations, little color misalignment occurs. Although not discussed here, magenta and cyan also have color misalignment, but it is not so noticeable as yellow and black.

It is known that the torque fluctuations shown in FIG. 3 increase as the difference in peripheral speed between the photosensitive drums and the belt increases, and the generation of belt speed fluctuations due to torque fluctuations is principally caused by insufficient rigidity of the belt drive transmission system.

Thus, this embodiment takes measures to reduce the difference in peripheral speed between the drums and the belt, which is the cause of torque fluctuations.

Here, the difference in peripheral speed between the photosensitive drums and the intermediate transfer belt can be reduced to a certain extent when the manufacturing tolerance of components that determine the individual speeds is reduced. However, reducing dimension errors of the components will inevitably increase manufacturing costs. Accordingly, to reduce the torque fluctuations shown in FIG. 3, this embodiment takes measures to prevent the color misalignment by changing the peripheral speed of the drums of stations where image formation is not performed during image formation.

For the measures, first, the configuration of relevant components will be described, and thereafter, the control sequence thereof will be described hereinbelow.

Description of Driving Unit

Figure 5:
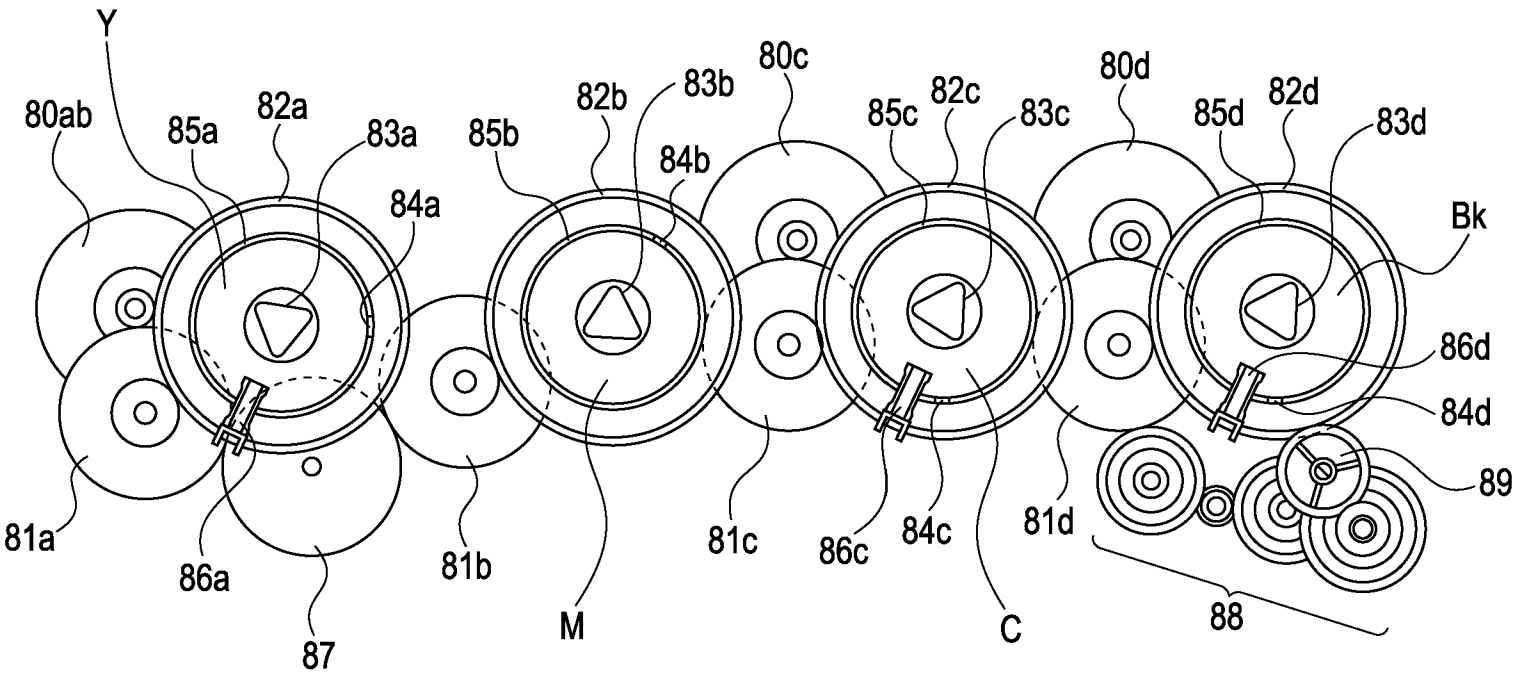
FIG. 5 is a diagram showing a gear train that drives photosensitive drums and the intermediate transfer belt.

FIG. 5 shows a driving unit that rotationally drives the photosensitive drums 26 and the intermediate transfer belt 30.

Three drive motors 80 (80*ab*, 80*c*, and 80*d*) for rotationally driving four photosensitive drums 26 and the intermediate transfer belt 30 are provided.

The first drive motor 80*ab* is configured to rotationally drive the photosensitive drum 26Y for yellow (first station) and the photosensitive drum 26M for magenta (second station). The second drive motor 80*c* is configured to rotationally drive the photosensitive drum 26C for cyan (third station). The third drive motor 80*d* is configured to rotationally drive the photosensitive drum 26Bk for black (fourth station) and the intermediate transfer belt 30.

The intermediate transfer belt 30 is configured to transmit driving from a gear 89 via a gear train 88 to a gear (not shown) on the shaft of the driving roller 100.

Figure 6:
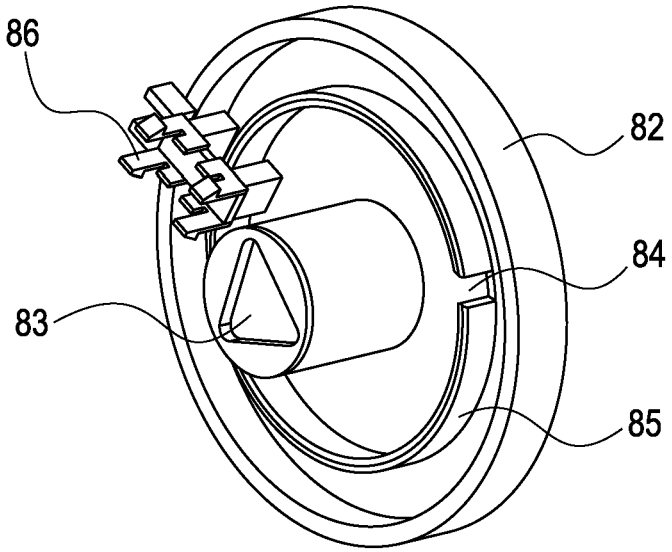
FIG. 6 is a diagram showing a gear that drives a photosensitive drum.

Furthermore, the intermediate transfer belt 30 is configured to transmit driving to photosensitive-drum drive gears 82 (82*a*, 82*b*, 82*c*, and 82*d*) (see FIG. 6) that are integrated with couplings 83 (83*a*, 83*b*, 83*c*, and 83*d*) from the drive motors 80 (80*ab*, 80*c*, and 80*d*) via reduction gears 81 (81*a*, 81*b*, 81*c*, and 81*d*) and to transmit driving to the photosensitive drums 26 via the couplings 83 (83*a*, 83*b*, 83*c*, and 83*d*).

To prevent color misalignment due to the gear accuracy of the drive gears 82 (82*a*, 82*b*, 82*c*, and 82*d*), the drive gears 82 (82*a*, 82*c*, and 82*d*) are provided with cylindrical flanges 85 (85*a*, 85*c*, and 85*d*) having slits 84 (84*a*, 84*c*, and 84*d*). The slits 84 (84*a*, 84*c*, and 84*d*) are detected by photointerupters 86 (86*a*, 86*c*, and 86*d*) provided at the driving unit, and the phases of the drive gears 82 (82*a*, 82*c*, and 82*d*) relative to the image position are aligned for the individual colors.

Here, the drive gears 82 (82*a* and 82*b*) of the first station and the second station are assembled, with their relative phases aligned when the gear train is assembled. All the drive gears 82 (82*a*, 82*b*, 82*c*, and 82*d*) are made of the same molded cabinets so that the fluctuation profile of one rotation cycle can be made equal to allow the profiles of the colors to be made equal by aligning the phases, thereby reducing color misalignment. The phase aligning operation for the drive gears 82 (82*a*, 82*c*, and 82*d*) is performed at the timing other than during an image forming operation, such as the end or start of a print job, and is achieved by accelerating or decelerating the object drive gear 82 corresponding to a reference color.

In the driving unit, described with reference to FIG. 5, when a load is applied to any of the components, components made of resin deflect in particular. For example, if a heavy load is applied more to the photosensitive drum 26Y, the reduction gear 81*a*, the drive gear 82*a*, etc. deflect more. For example, if a heavy load is applied more to the photosensitive drum 26M, the reduction gear 81*b*, a gear 87, the drive gear 82*b*, the flange 85*b*, etc. deflect more. For example, if a heavy load is applied more to the photosensitive drum 26C, the reduction gear 81*c*, the drive gear 82*c*, etc. deflect more. For example, if a heavy load is applied more to the photosensitive drum 26Bk, the reduction gear 81*d*, the drive gear 82*d*, etc. deflect more. Furthermore, for example, a heavy load is applied more to the intermediate transfer belt, 30 the gears of the gear train 88 deflect more. The color misalignment due to such deflection can be reduced by controlling the components according to the following control sequence so that the load between the drums and the belt during image formation match a reference load.

Description of Control Sequence

Figure 7:
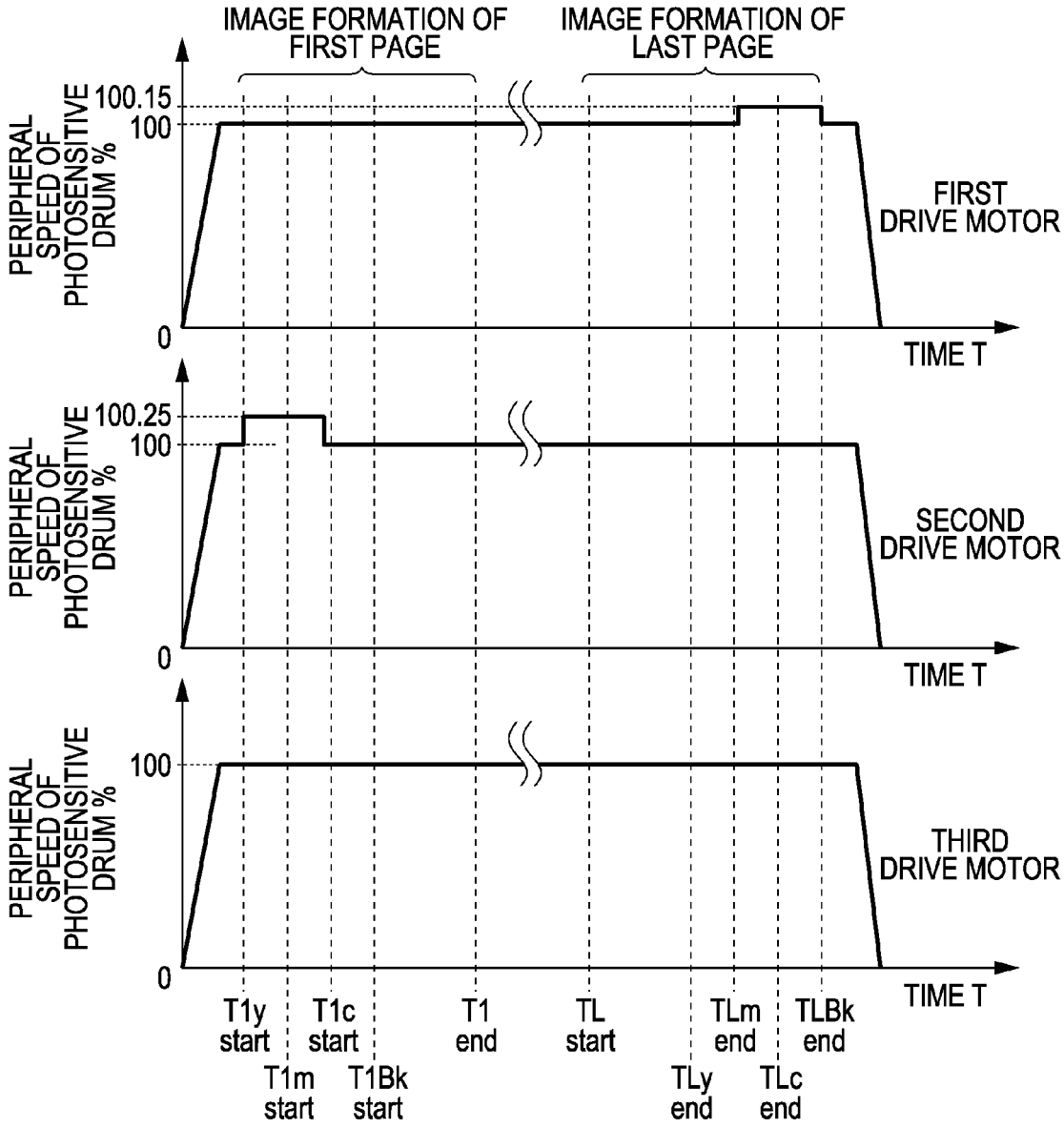
FIG. 7 is a timing chart showing the driving state of drive motors.

FIG. 7 is a timing chart showing the control sequence of the drive motors 80 of this embodiment. "T1*y* start", "T1*m* start", "T1*c* start", and "T1Bk start" indicate the timing at which image formation of the first pages of the individual colors start. The start of image formation here indicates the timing at which electrostatic latent images begin to be formed on the photosensitive drums by irradiation of laser beams. Actually, the developing rollers 54 of the individual colors have already come into contact with the photosensitive drums 26 and fogged toner has already reached the primary-transfer nip portion directly before the irradiation of laser beams. Accordingly, the image-formation start timing may generally be set at the timing at which the developing rollers 54 come into contact with corresponding photosensitive drums 26.

On the other hand, "TLy end", "TLm end", "TLc end", and "TLBk end" indicate the timing at which image formation of the last pages of the individual colors ends. The timing at which image formation ends here indicates the timing at which the primary transfer ends. Actually, the developing rollers 54 have already been separated from the photosensitive drums 26 directly after or directly before the primary transfer ends. Accordingly, the image-formation end timing may generally be set at the timing at which the developing rollers 54 are separated from corresponding photosensitive drums 16.

In the description below, to discriminate the photosensitive drums 26 of Y, M, C, and K, they are sometimes referred to as a first photosensitive drum (first photosensitive member), a second photosensitive drum (second photosensitive member), a third photosensitive drum (third photosensitive member), and a fourth photosensitive drum (fourth photosensitive member). On the other hand, when forming a toner image with one photosensitive drum, this photosensitive drum may be discriminated as a first photosensitive drum, and a photosensitive drum that is increased or decreased in speed to reduce load fluctuations may be discriminated as a second photosensitive drum; various ways of discrimination are assumed. In the description below, a description in which the four photosensitive drums are discriminated will first be made.

First, although the order is reversed, the third drive motor 80*d* will be described. Changing the peripheral speed (moving speed) of the intermediate transfer belt 30 during an image forming operation will cause color misalignment. Accordingly, the third drive motor 80*d* that drives both the photosensitive drum 26Bk for black and the intermediate transfer belt 30 is set to normally rotate steadily at a predetermined speed during an image forming operation. Next control in the individual intervals included in FIG. 7 will be described in sequence.

(i) T1*y* Start≦T<T1*c* Start

Figure 8:
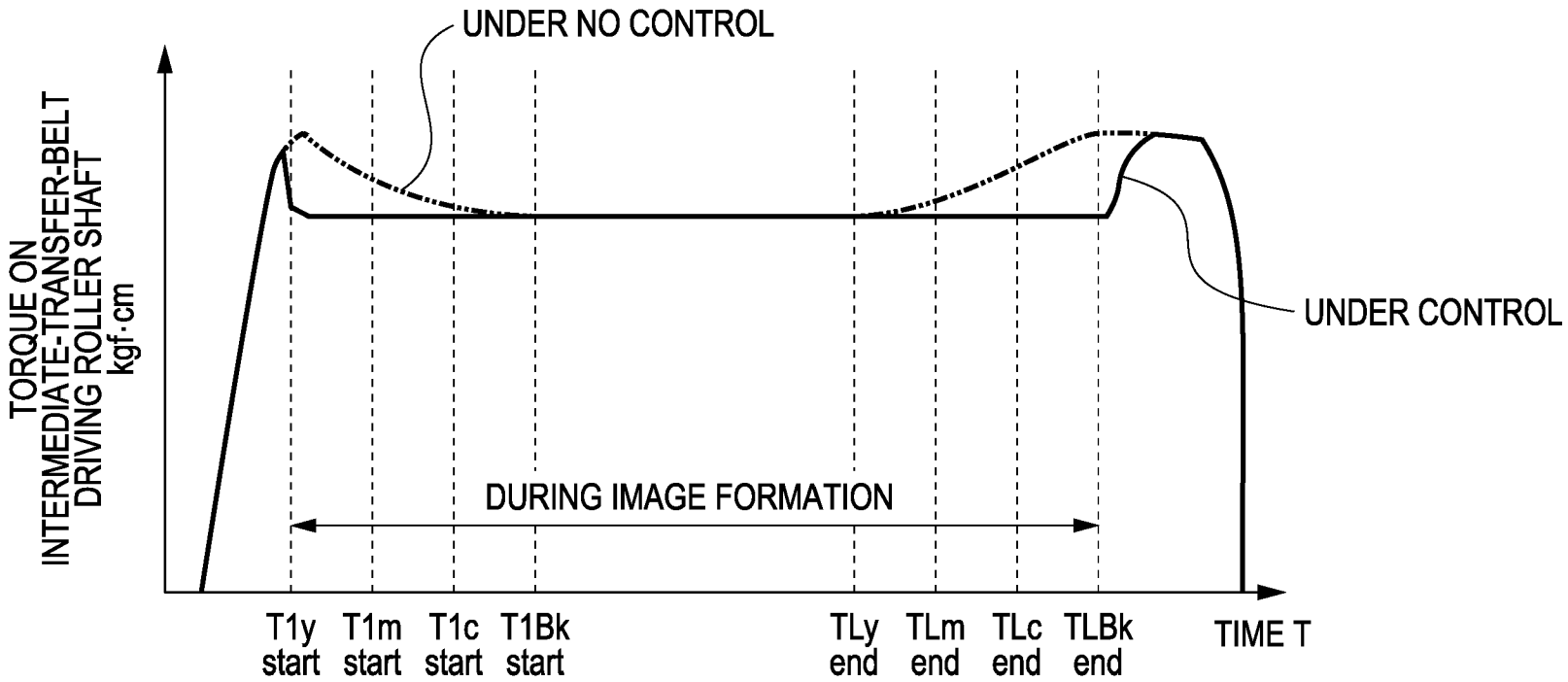
FIG. 8 is a diagram showing torque fluctuations of the driving roller of the intermediate transfer belt during an image forming operation when control of the drive motors is executed.

In the interval (i), as indicated by the two-dot chain line in FIG. 8, a load on the intermediate transfer belt 30 is high because fogged toner has not yet sufficiently reached the primary-transfer nip portion of the individual colors. This interval corresponds to an interval in which a toner image is formed on the intermediate transfer belt 30 with part of the photosensitive drums.

On the other hand, the second drive motor 80*c* drives the photosensitive drum 26C for cyan. When performing an image forming operation for the first page, the photosensitive drum 26C disposed in a position other than the uppermost stream rotates 0.25% higher than usual from "T1*y* start" to directly before "T1*c* start". This speed control is performed according to an instruction of the CPU 121.

Since the peripheral speed of the photosensitive drum 26C is increased by 0.25% relative to a reference speed, the load (brake) applied to the intermediate transfer belt is decreased under the relation of photosensitive drum speed<intermediate transfer belt speed, thus solving the problem of significant load fluctuations. In other words, the total load generated between the intermediate transfer belt and the individual photosensitive drums can be controlled so as to at least come close to a reference load (the reference load will be defined later).

The speed increasing control will be described in more detail. As shown in FIG. 3, when the image forming operation is started, toner gradually comes more between the photosensitive drum 26 and the intermediate transfer belt 30. Then, the load applied on the intermediate transfer belt 30 decreases gradually. The phenomenon in which the load decreases gradually is also indicated by the two-dot chain line for "under no control" in FIG. 8. That is, increasing the peripheral speed of the photosensitive drum 26C for cyan at the above-described timing can decrease the torque on the driving roller shaft to a steady torque directly after "T1*y* start", that is, the start of the image forming operation. Thus, the image forming operation can be performed without the influence of the presence of toner. The steady torque corresponds to, for example, torque on the driving roller shaft in the interval from "T1Bk start" to "TLy end", which corresponds to a load that is desired to be generated always stably for image formation. This steady torque is sometimes referred to as a reference load, which will be described in the following interval (ii).

Although the above interval (i) is described using an example in which the speed of the second drive motor 80*c* is increased substantially at the same time as "T1*y* start", the invention is not limited thereto. At least, the speed of a photosensitive drum that is not forming a toner image should be controlled to a reference load while forming a toner image on the intermediate transfer belt by the photosensitive drum 26Y, which is the first photosensitive member.

(ii) T1*c* Start≦T<TLm End

In the interval from "T1*c* start" before "TLm end", control for increasing or decreasing the peripheral speeds (moving speeds) of the individual photosensitive drums is not performed. That is, the control is performed by the CPU 121 so that the individual photosensitive drums are rotated at a normal rotation speed.

The load generated between all the photosensitive drums (photosensitive members) and the intermediate transfer belt (transfer member) while all the photosensitive drums are forming toner images on the intermediate transfer belt in the interval (ii) are the target reference load to be performed in the other intervals. The state in which this reference load is generated corresponds to the state in FIG. 17 described before, in which the force, μ2F×4, included in Eq. (7) is generated between the individual photosensitive drums and the intermediate transfer belt.

(iii) TLm End<T≦TLBk End

In this embodiment, the first drive motor 80*ab* drives the photosensitive drums 26Y and 26M for yellow and magenta, disposed at positions other than the lowermost stream. The photosensitive drums 26Y and 26M rotate while increasing in speed 0.15% higher than the reference during the interval other than the foregoing interval (i), that is, directly after "TLm end" at which the primary transfer of magenta of the image of the last page ends to "TLBk end" at which the primary transfer of black ends. This speed control is performed according to an instruction of the CPU 121. This interval also corresponds to an interval in which a toner image is formed on the intermediate transfer belt 30 with part of the photosensitive drums, as in the interval (i). Also in this case, the total load generated between the intermediate transfer belt and the individual photosensitive drums can be controlled so as to at least come close to the reference load.

Here, the speed increasing control will be described in more detail. As shown in FIG. 3, when the image forming operation comes close to end, the fogged toner decreases from between the photosensitive drums 26 and the intermediate transfer belt 30, and the load on the intermediate transfer belt 30 increases gradually. The phenomenon in which the load increases gradually is also indicated by the two-dot chain line for "under no control" in FIG. 8.

To cope with it, by increasing the peripheral speeds of the photosensitive drums 26Y and 26M for yellow and magenta by 0.15% relative to the reference, the torque on the driving roller shaft can be maintained at a steady torque until completion of the image forming operation. Thus, the image forming operation can be performed without influence of the presence of toner.

Although the above interval (iii) is described using an example in which the speed of the first drive motor 80*ab* is increased substantially at the same time as "TLm end", the invention is not limited thereto. At least, the speed of a photosensitive drum that is not forming a toner image should be controlled to the reference load (at least to come close thereto) while forming a toner image on the intermediate transfer belt by the photosensitive drums 26C and 26Bk, which is the third and fourth photosensitive members.

Advantages of First Embodiment

Thus, driving torque fluctuations of the intermediate transfer belt due to the start of contact and separation of the developing units can be prevented by controlling the peripheral speeds (moving speeds) of the photosensitive drums 26 by the CPU 121 so as to reduce device costs and not to waste the life of the components. Accordingly, driving torque fluctuations of the intermediate transfer belt during image formation are small. Therefore, the belt peripheral speed can be held constant, and as a result, a high-quality image without color misalignment can be output.

Of the photosensitive drums 26 that are not performing image formation, a photosensitive drum whose peripheral speed is controlled is located as far as possible from photosensitive drums (for example, 26Y and 26M) in which fluctuations in the presence of toner occur at the primary-transfer nip portion. This can prevent vibrations at the primary-transfer nip portion. The vibrations may cause variations in the state of primary transfer to cause banding and density variations.

Since the amount of change in peripheral speed is a known value, it is confirmed that the phase shift of the drive gears, described above, is a value that has little influence (in this embodiment, about 2°), so that the color misalignment is not worsened.

However, for continuous printing in which the drive motors 80 are not stopped so that the contact/separation operation of the developing units is repeated, color misalignment can be prevented from worsening by performing control to return the phases of the drive gears 82 during the contact/separation operation.

Since the phase shift amount is known, it is also effective to execute phase alignment considering the known phase shift amount of the drive gears 82 according to this embodiment.

In the above-described embodiment, a configuration in which three drive motors are disposed as the driving source for the photosensitive drums 26 and the intermediate transfer belt has been described. Here, another form for controlling the speed of a photosensitive drum that is not forming a toner image so as to apply a reference load during forming a toner image on the intermediate transfer belt will be described.

In this embodiment, four drive motors 80 are provided, and one of the drive motors 80 drives both the photosensitive drum 26 and the intermediate transfer belt 30, and the other drive motors 80 individually control the peripheral speeds of the other three photosensitive drums 26. This can reduce the difference in peripheral speed between the photosensitive drums 26 and the intermediate transfer belt 30 to prevent the occurrence of color misalignment and to improve the recording accuracy of an output image. This will be described below in detail.

Since the configuration of the image forming apparatus is the same as the configuration of the image forming apparatus 1 shown in FIG. 1, descriptions of duplicated components will be omitted.

Figure 9:
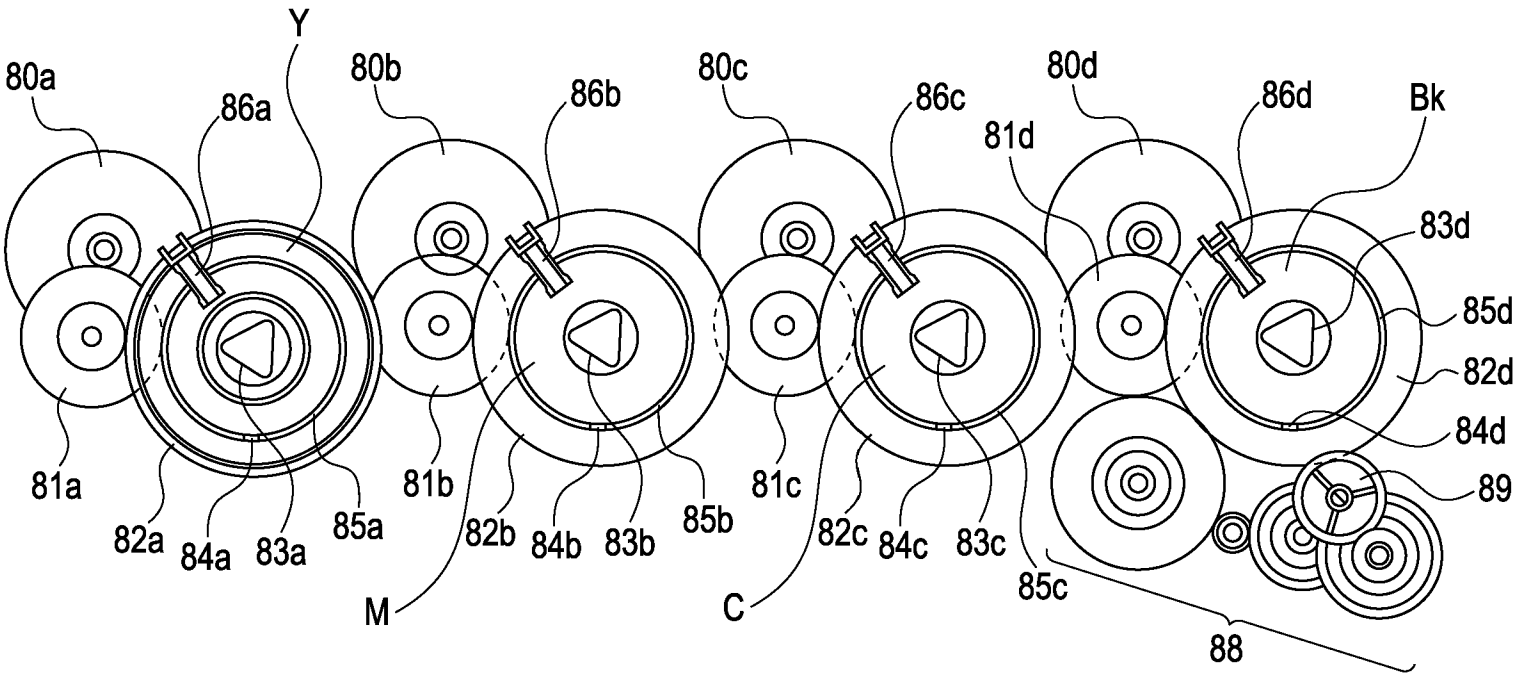
FIG. 9 is a diagram showing a gear train that drives photosensitive drums and the intermediate transfer belt.

FIG. 9 shows a driving unit that rotationally drives the photosensitive drums 26 and the intermediate transfer belt 30. There are four drive motors 80 (80*a*, 80*b*, 80*c*, and 80*d*) for rotationally driving four photosensitive drums 26 and the intermediate transfer belt 30.

The first drive motor 80*a* is configured to rotationally drive a photosensitive drum 26Y for yellow (first station). The second drive motor 80*b* is configured to rotationally drive a photosensitive drum 26M for magenta (second station). The third drive motor 80*c* is configured to rotationally drive a photosensitive drum 26C for cyan (third station). The fourth drive motor 80*d* is configured to rotationally drive a photosensitive drum 26Bk for black (fourth station) and the intermediate transfer belt 30.

The intermediate transfer belt 30 is configured to transmit driving to gears (not shown) on the shaft of a driving roller 100 via a gear train 88.

Furthermore, it is configured to transmit driving from the drive motors 80 (80*a*, 80*b*, 80*c*, and 80*d*) via reduction gears 81 (81*a*, 81*b*, 81*c*, and 81*d*) to photosensitive drum drive gears 82 (82*a*, 82*b*, 82*c*, and 82*d*) (see FIG. 6) integrated with couplings 83 (83*a*, 83*b*, 83*c*, and 83*d*) and to transmit driving to the photosensitive drums 26 via the couplings 83 (83*a*, 83*b*, 83*c*, and 83*d*). The drive gears 82 (82*a*, 82*b*, 82*c*, and 82*d*) are provided with cylindrical flanges 85 (85*a*, 85*b*, 85*c*, and 85*d*) having slits 84 (84*a*, 84*b*, 84*c*, and 84*d*) to prevent color misalignment due to the gear accuracy of the drive gears 82 (82*a*, 82*b*, 82*c*, and 82*d*). The slits 84 (84*a*, 84*b*, 84*c*, and 84*d*) are detected by photointerrupters 86 (86*a*, 86*b*, 86*c*, and 86*d*) provided for the driving unit, and the phases of the drive gears 82 (82*a*, 82*b*, 82*c*, and 82*d*) relative to image positions are aligned for the individual colors.

All the drive gears 82 (82*a*, 82*b*, 82*c*, and 82*d*) are made of the same molded cabinets so that the fluctuation profile of one rotation cycle can be made equal to allow the profiles of the colors to be made equal by aligning the phases, thereby reducing color misalignment. The phase aligning operation for the drive gears 82 (82*a*, 82*b*, 82*c*, and 82*d*) is performed at the timing other than during an image forming operation, such as the end or start of a print job, and is achieved by accelerating or decelerating the object drive gear 82 corresponding to a reference color.

Description of Control Sequence

Figure 10:
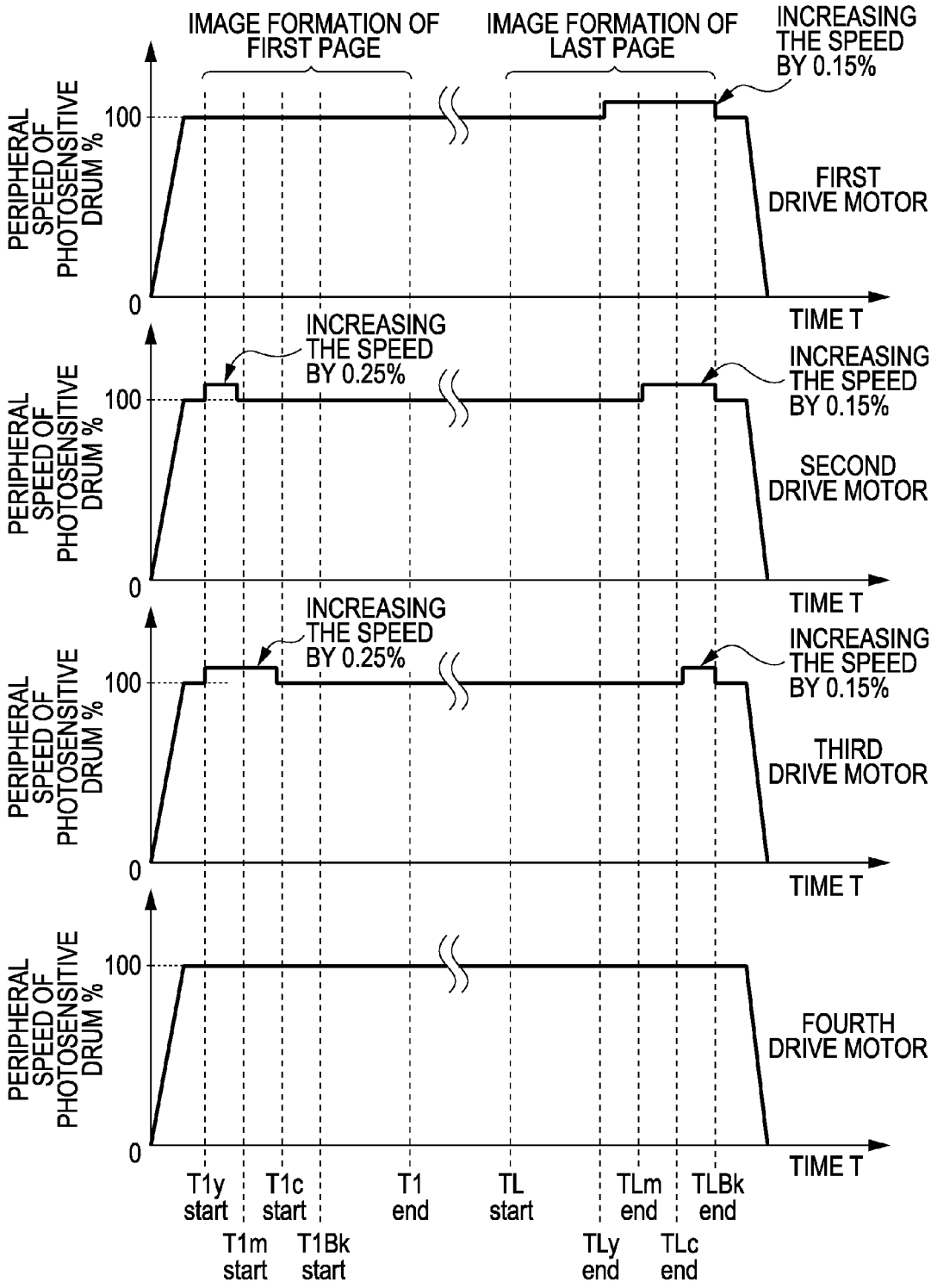
FIG. 10 is a timing chart showing the driving state of the drive motors.
Figure 11:
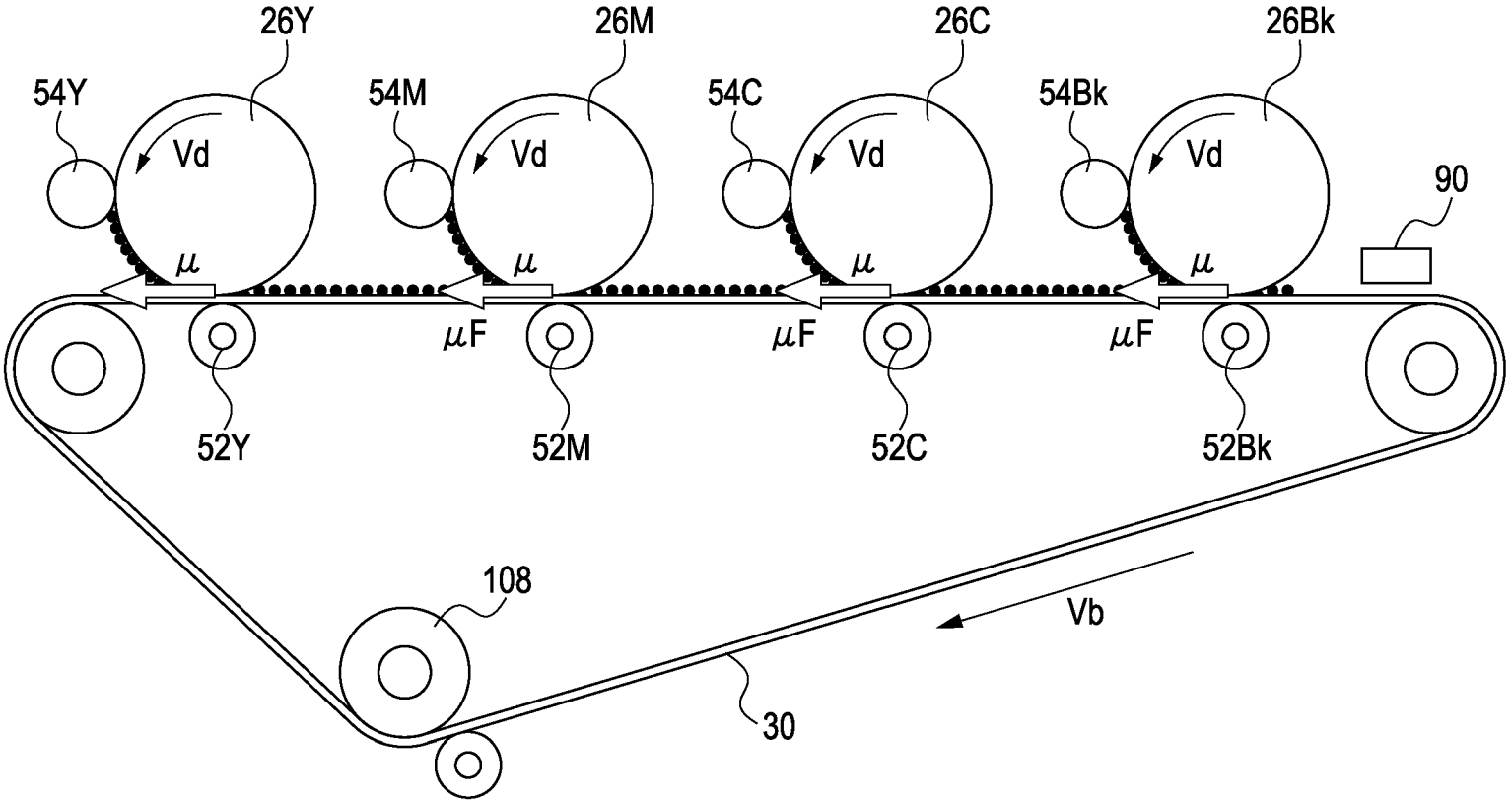
FIG. 11 is a diagram showing the state of a load torque applied on the belt.
Figure 12:
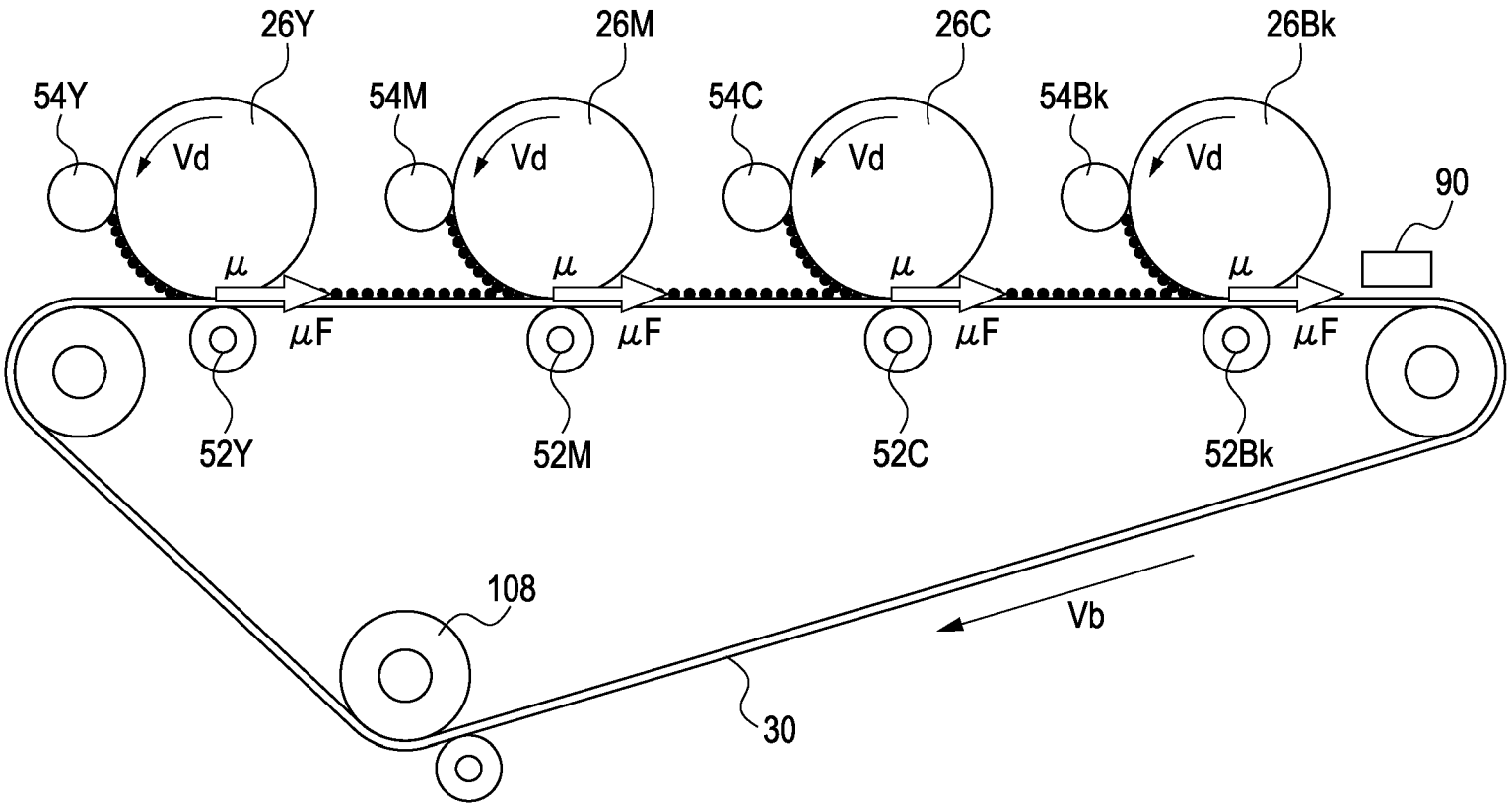
FIG. 12 is a diagram showing the state of a load torque applied on the belt.
Figure 13:
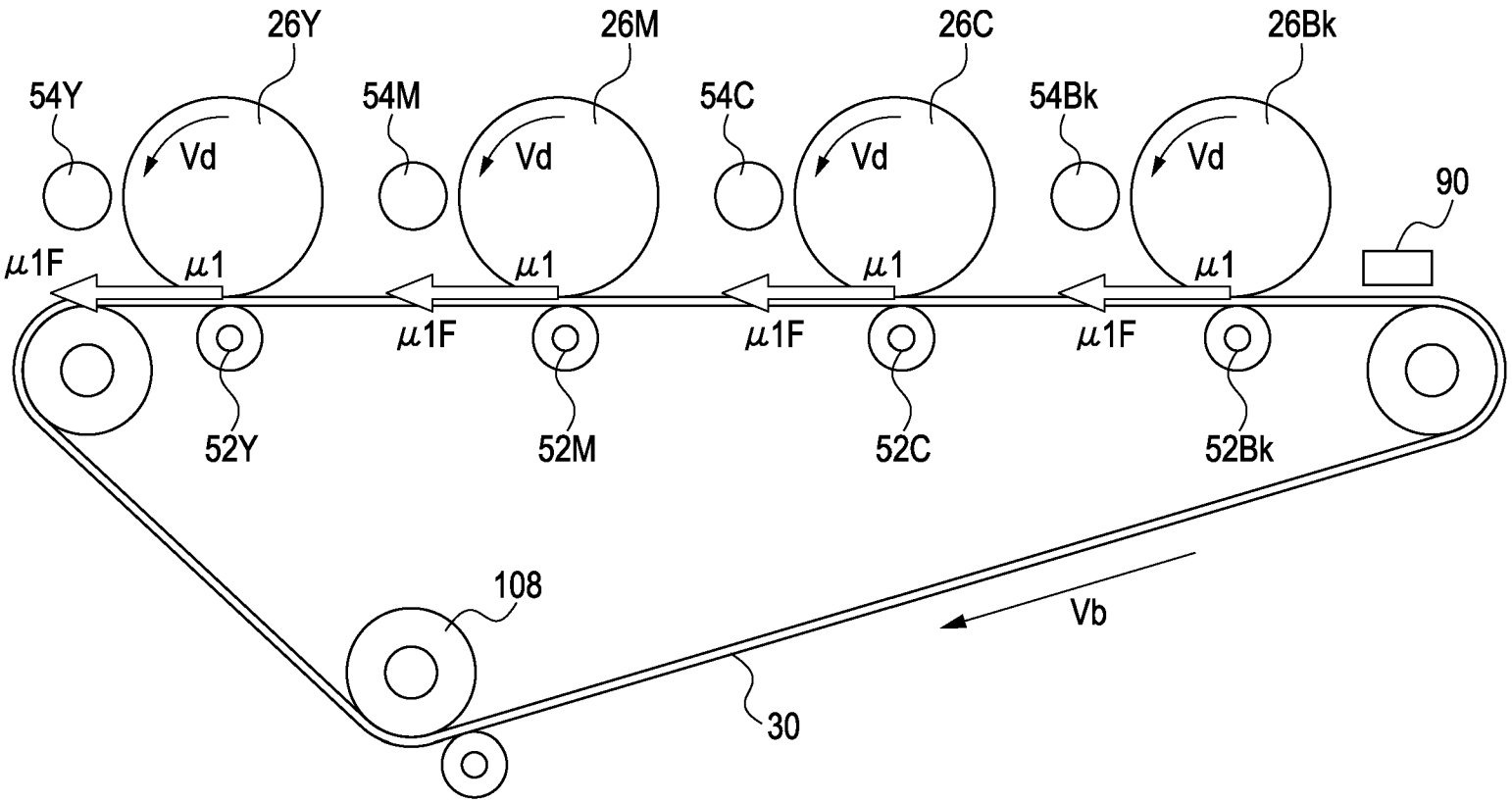
FIG. 13 is a diagram showing the state of a load torque applied on the belt.
Figure 14:
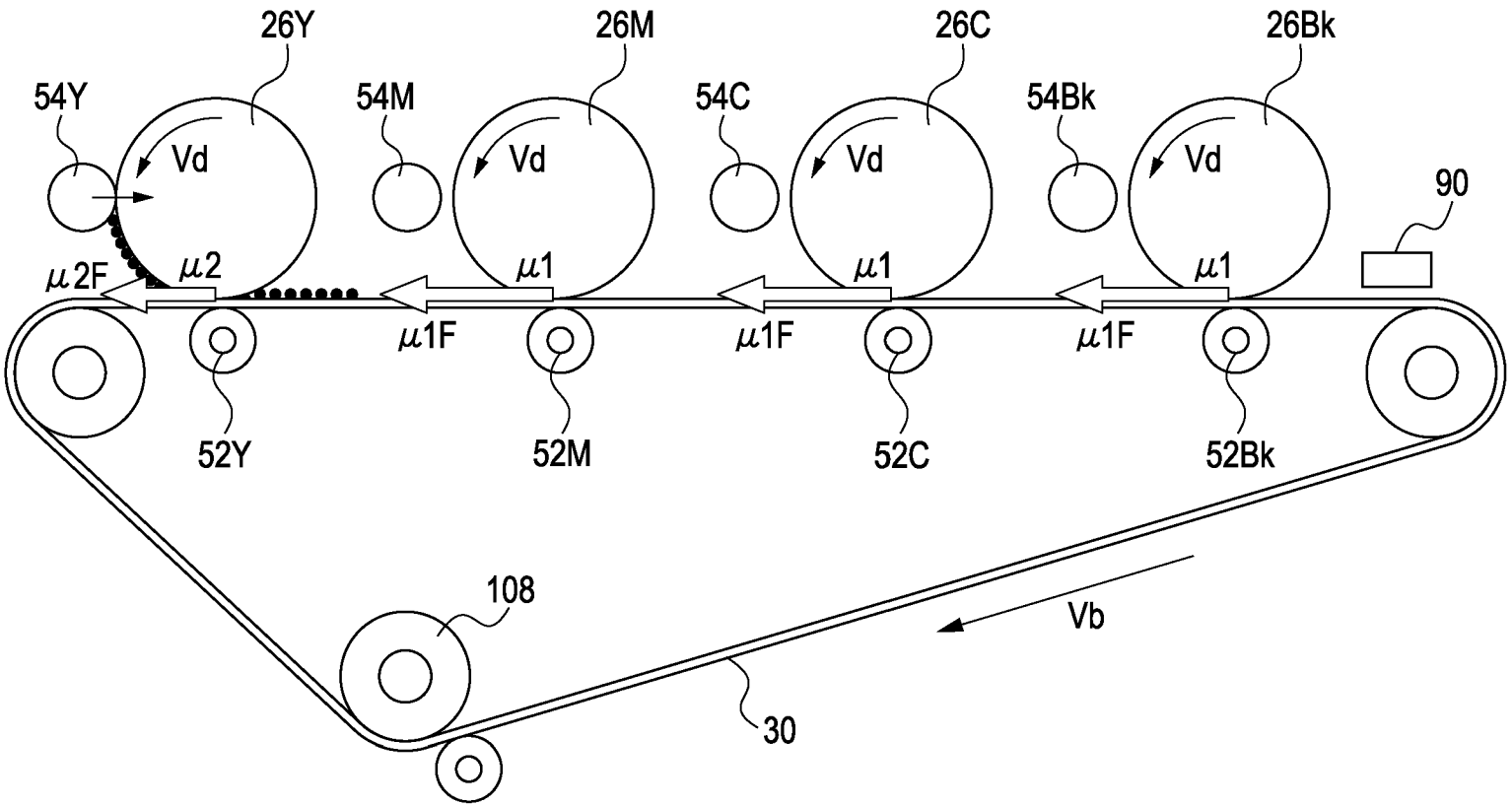
FIG. 14 is a diagram showing the state of a load torque applied on the belt.
Figure 15:
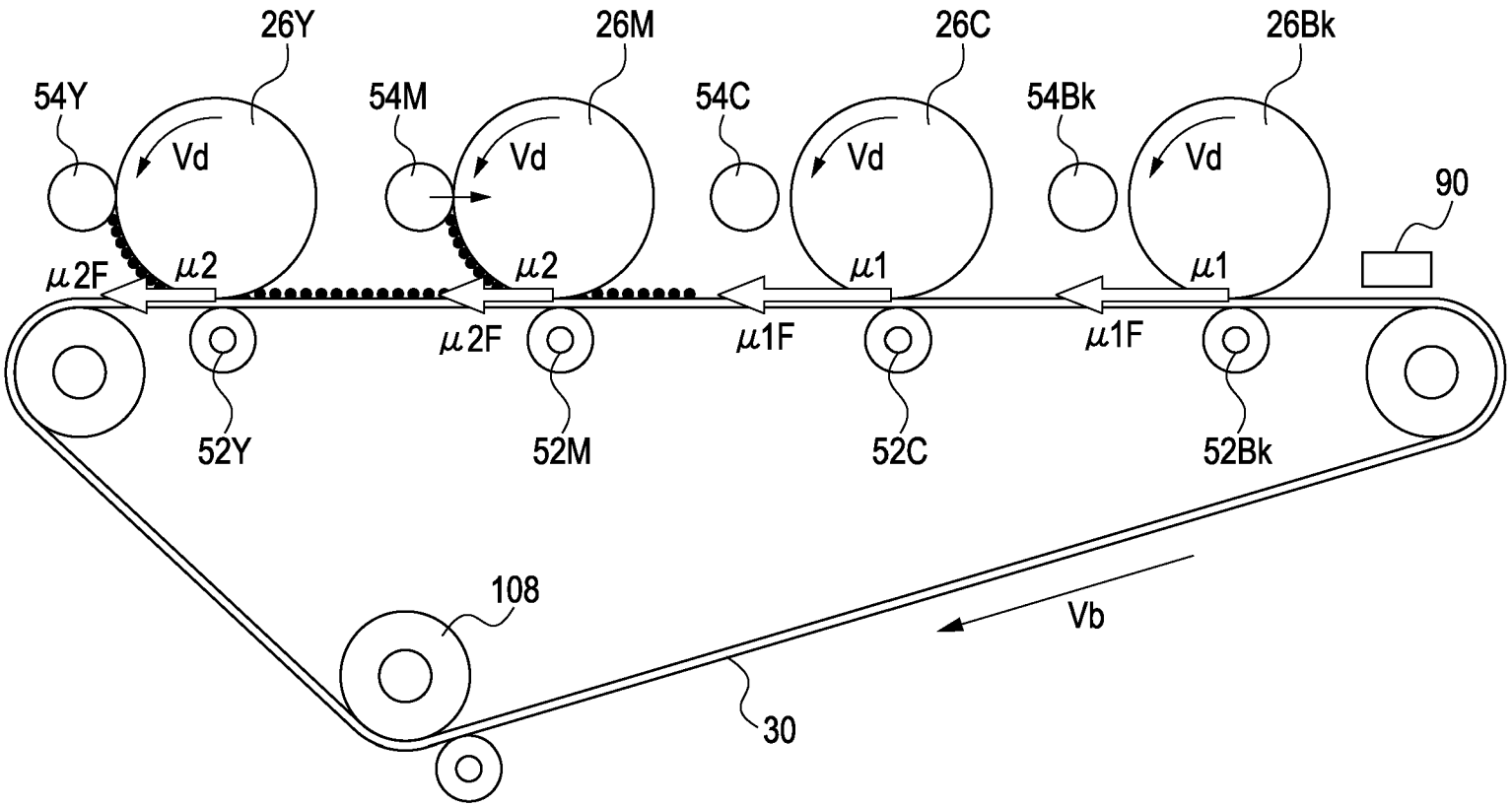
FIG. 15 is a diagram showing the state of a load torque applied on the belt.
Figure 16:
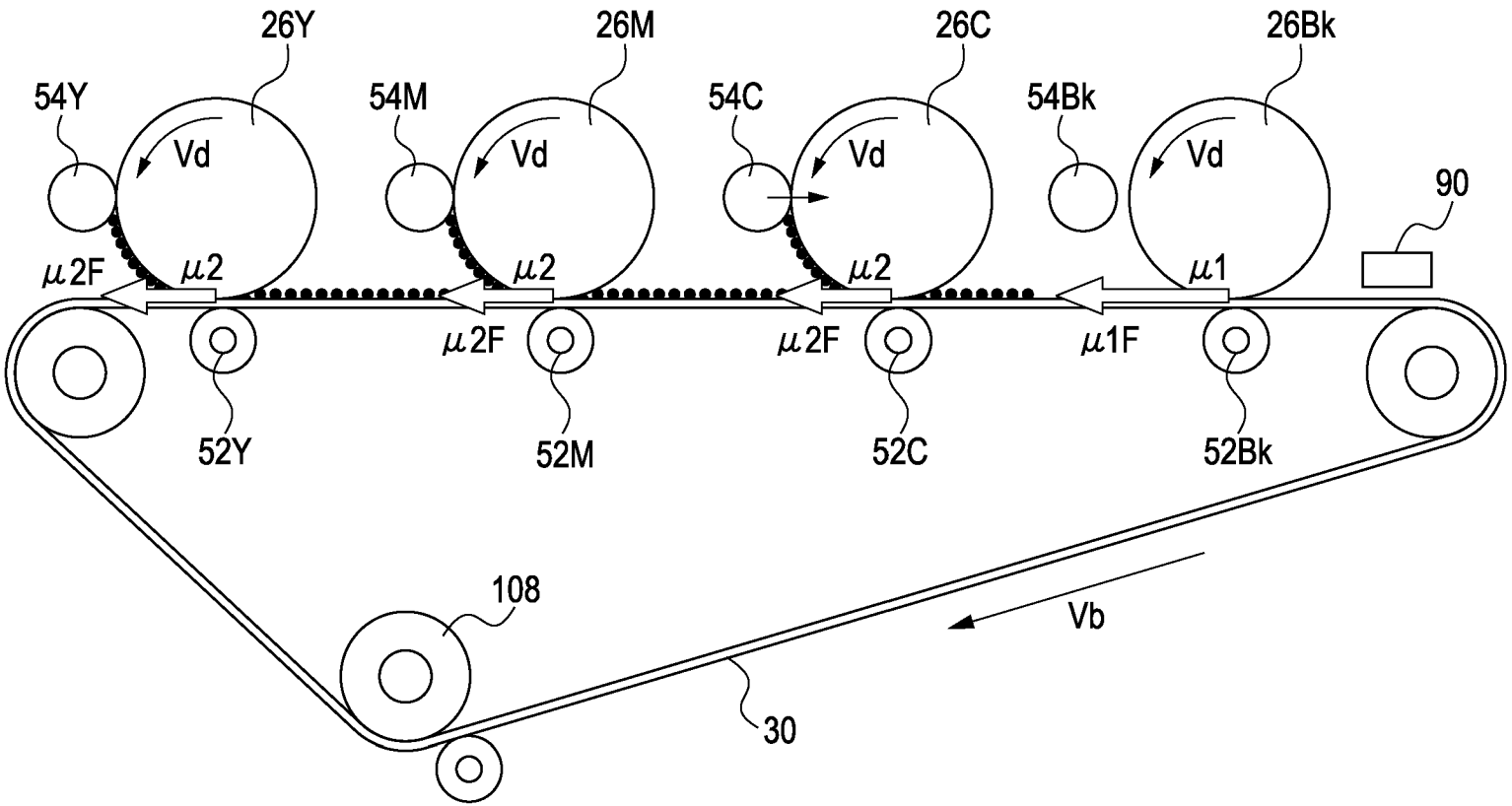
FIG. 16 is a diagram showing the state of a load torque applied on the belt.

FIG. 10 is a timing chart showing the control sequence of the drive motors 80 of this embodiment. "T1*y* start", "T1*m* start", "T1*c* start", "T1Bk start", "TLy end", "TLm end2, "TLc end", and "TLBk end" are the same as in the first embodiment.

Changing the peripheral speed of the intermediate transfer belt 30 during an image forming operation will cause color misalignment. Accordingly, the fourth drive motor 80*d* that drives both the photosensitive drum 26Bk for black and the intermediate transfer belt 30 is set to normally rotate steadily at a predetermined speed during the image forming operation.

(i) T1*y* Start≦T<T1*c* Start

The second drive motor 80*b* drives the photosensitive drum 26M for magenta. The third drive motor 80*c* drives the photosensitive drum 26C for cyan. This interval corresponds to an interval in which a toner image is formed on the intermediate transfer belt 30 with part of the photosensitive drums. When performing an image forming operation for the first page, the photosensitive drum 26M disposed in a position other than the uppermost stream rotates 0.25% higher than usual from "T1*y* start" to directly before "T1*c* start". This speed control is performed according to an instruction of the CPU 121. Thus, the total load generated between the intermediate transfer belt and the individual photosensitive drums can be controlled so as to at least come close to a reference load. This also applies to intervals (iii) to (v) below.

From "T1*y* start" to directly before "T1*c* start", the photosensitive drum 26C disposed at a position other than the uppermost stream rotates 0.25% higher than usual. This speed control is also performed according to an instruction of the CPU 121. Although both the second and third drive motors 80*b* and 80*c* are increased in speed by 0.25%, they may be increased by 0.15% depending on the characteristics of the photosensitive drums 26M and 26C and the intermediate transfer belt 30.

(ii) T1*c* Start≦T<TLy End

In the interval after "T1*c* start" before "TLy end", control for increasing or decreasing the peripheral speeds (moving speeds) of the individual photosensitive drums is not performed. That is, the control is performed by the CPU 121 so that the individual photosensitive drums are rotated at a normal rotation speed.

(iii) TLy End≦T<TLm End

The first drive motor 80*a* drives the photosensitive drum 26Y for yellow. In the interval after "TLy end" to before "TLm end" in which the image on the last page has completed primary transfer of yellow, the photosensitive drum 26Y disposed at a position other than the lowermost stream rotates 0.15% higher than usual. This speed control is performed according to an instruction of the CPU 121. This interval also corresponds to an interval in which a toner image is formed on the intermediate transfer belt 30 by part of the photosensitive drums.

(iv) TLm End≦T<T Lc End

In the interval after "TLm end" to before "TLc end", the drive motors 80*a* and 80*b* corresponding to the photosensitive drums 26Y and 26M rotate 0.15% higher than usual. This speed control is also performed according to an instruction of the CPU 121. This interval also corresponds to an interval in which a toner image is formed on the intermediate transfer belt 30 by part of the photosensitive drums.

(v) TLc End≦T<TLBk End

In the interval after "TLc end" to before "TLBk end", the drive motors 80*a*, 80*b*, and 80*c* corresponding to the photosensitive drums 26Y, 26M, and 26C disposed in positions other than the lowermost stream rotate 0.15% higher than usual. This speed control is also performed according to an instruction of the CPU 121. This interval also corresponds to an interval in which a toner image is formed on the intermediate transfer belt 30 by part of the photosensitive drums.

In the second embodiment, the relationship between changes in the peripheral speed of the photosensitive drums by speed control and load on the intermediate transfer belt is omitted because it is the same as that of the first embodiment.

Thus, driving torque fluctuations of the intermediate transfer belt due to the start of contact and separation of the developing units can be prevented by controlling the peripheral speeds (moving speeds) of the photosensitive drums 26 by the CPU 121, thereby providing the same advantages as the first embodiment.

In the above embodiments, the color-image forming apparatus has been described on the assumption that photosensitive drum speed<intermediate transfer belt speed. However, the invention is not limited thereto. The invention can be applied also to a color-image forming apparatus in which photosensitive drum speed>intermediate transfer belt speed.

In the case of photosensitive drum speed>intermediate transfer belt speed, the photosensitive drum speed acts to increase the rotation of the intermediate transfer belt. Therefore, this creates a need for speed control to contrarily slow down the photosensitive drum speed so that the photosensitive drums do not excessively increase the rotation of the intermediate transfer belt before a sufficient amount of fogged toner reaches the primary-transfer nip portions.

Accordingly, by decreasing the amount of increased photosensitive-drum peripheral speed, described in the first and second embodiments, the same operations and advantages, that is, the advantage of decreasing color misalignment can be provided during image formation for the first and last pages of an input job.

In the above embodiments, speed control of photosensitive members that are not forming toner images of both of the first and last pages has been described. However, from the viewpoint of not decreasing the productivity of the apparatus, at least from conventional ones, the following forms can also be considered.

Figure 17:
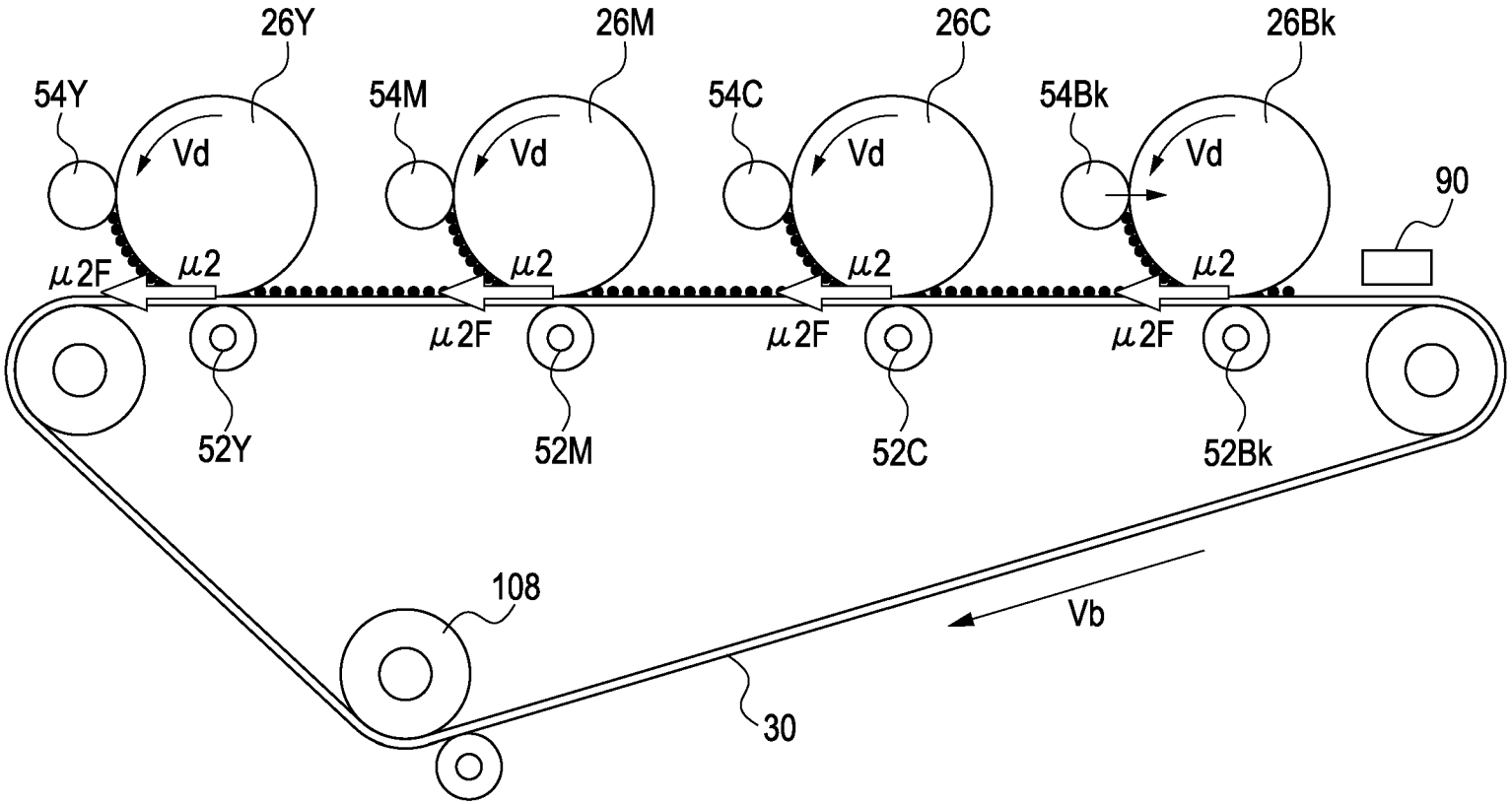
FIG. 17 is a diagram showing the state of a load torque applied on the belt.
Figure 18:
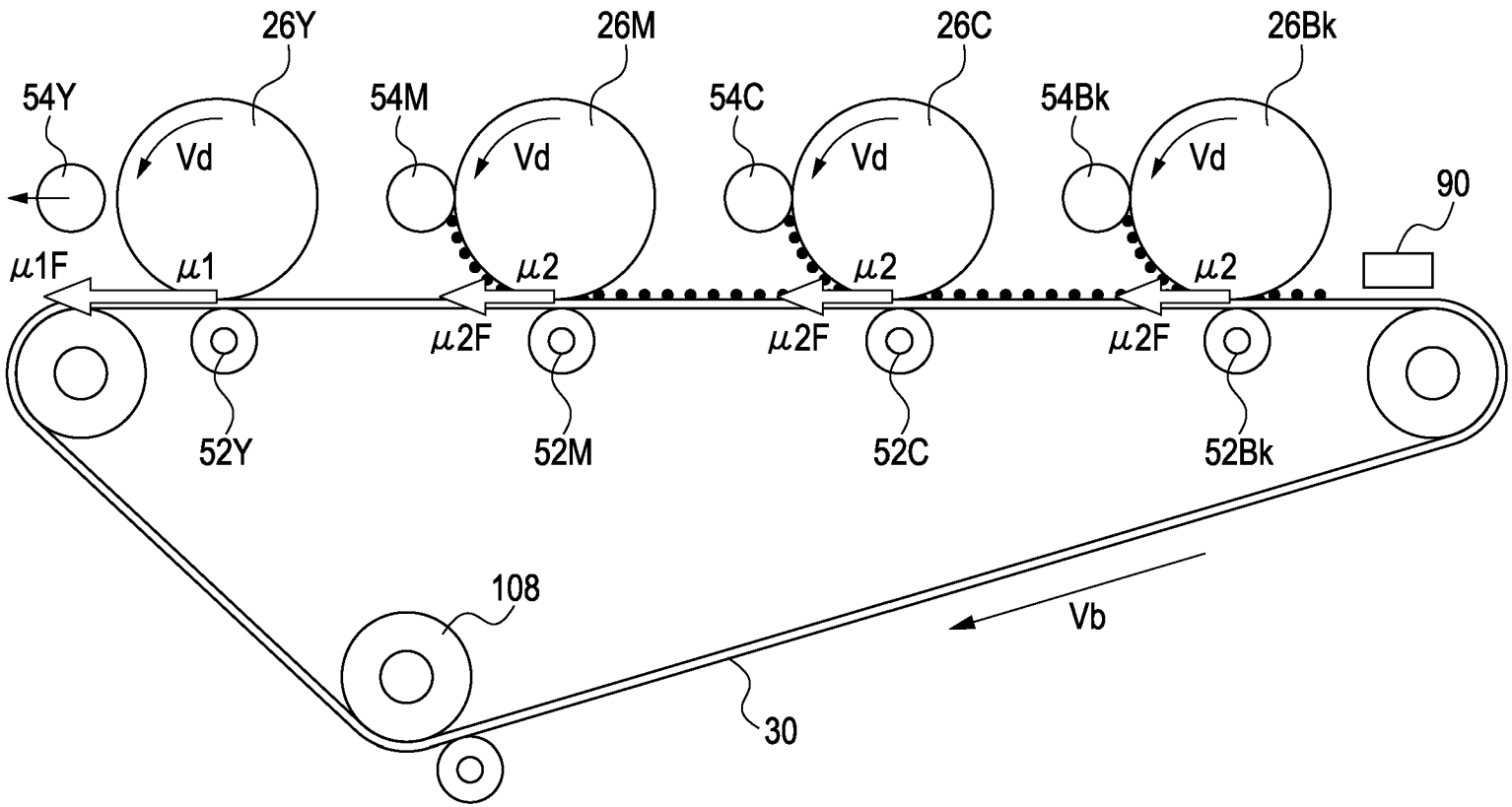
FIG. 18 is a diagram showing the state of a load torque applied on the belt.
Figure 19:
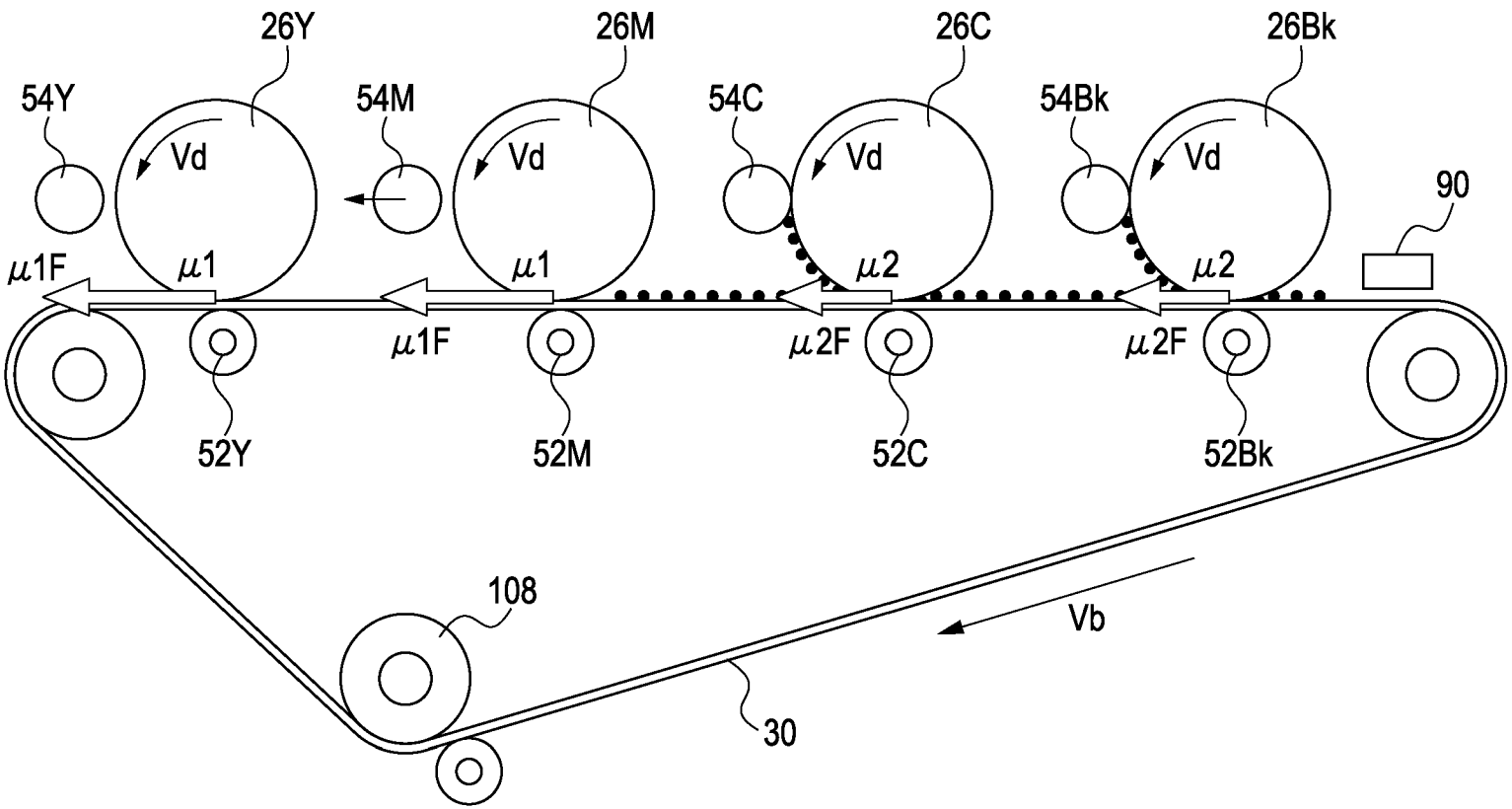
FIG. 19 is a diagram showing the state of a load torque applied on the belt.
Figure 20:
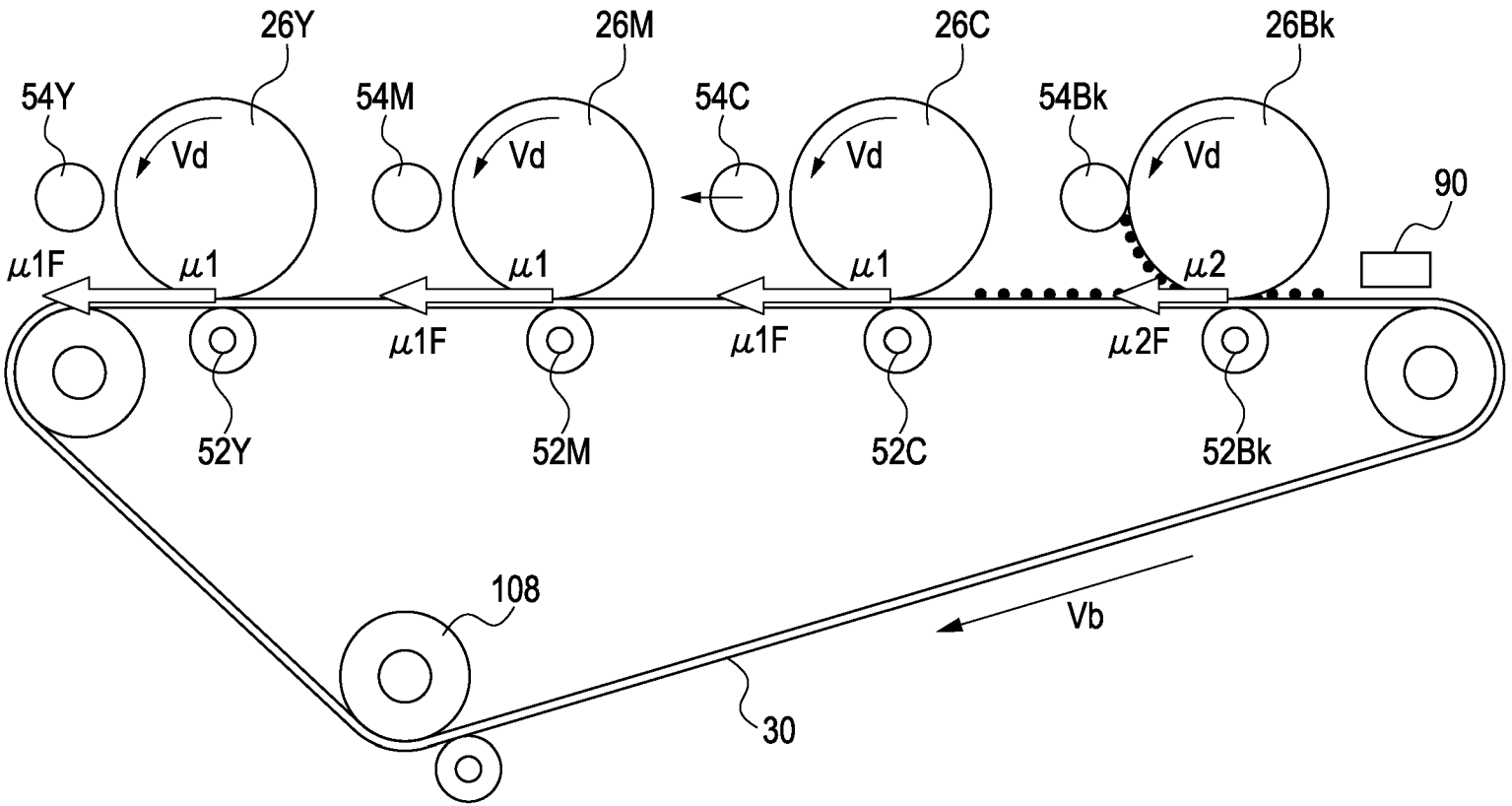
FIG. 20 is a diagram showing the state of a load torque applied on the belt.

That is, when forming a toner image of the first page, the operation shift shown in FIGS. 13 to 17 may be the state in FIG. 17, or alternatively, when forming a toner image of the last page, the operation shift shown in FIGS. 17 to 20 may be continuously held in the state in FIG. 17. In this case, the control described in the first to third embodiments is executed only for one of the toner image formation for the first page, which is not continuously held in the state in FIG. 17, and the toner image formation for the last page.

The fourth embodiment can also provide the same advantages, to some extent, as in the first to third embodiments.

In the foregoing embodiments, a case in which the drive motor 80*d* drives both the photosensitive drum 26Bk for black and the intermediate transfer belt 30 has been described. However, the invention is not limited thereto. For example, both the photosensitive drum 26*y* and the intermediate transfer belt 30 may be driven, and the photosensitive drum 26Bk and the intermediate transfer belt 30 may be driven by different drive motors.

In the case of FIG. 7, the photosensitive drum 26Y may be driven at a steady speed, and the photosensitive drums 26M and 26C may be increased in speed in the interval of TLc end<T≦TLBk end.

In the case in FIG. 9, the photosensitive drum 26Y may be driven at a steady speed, and the photosensitive drums 26M and 26C may be increased in speed and driven in the interval, TLm end≦T<TLBk end. At that time, increasing the speeds of the photosensitive drums 26M and 26C higher than 0.15% can provide more significant effects.

Thus, also by driving the image forming apparatus in this way, the same advantages as in the foregoing embodiments can be offered.

Although the foregoing embodiments are configured such that the peripheral speeds of the plurality of photosensitive drums are changed, the invention is not limited thereto. For example, control of changing the peripheral speed of only one photosensitive drum that is not performing image formation even during an image forming operation can offer the same advantages, and therefore, the speed control of only one photosensitive drum can be performed.

In the foregoing embodiments, four-color-image forming apparatuses equipped with the first to fourth photosensitive drums have been described; however, the invention may also be applied to, for example, six-color-image forming apparatus equipped with first to sixth photosensitive drums. In this case, the foregoing fourth photosensitive drum should be used as the sixth photosensitive drum, and the foregoing third photosensitive drum should be used as any of the third to fifth photosensitive drums (photosensitive members).

As described above, a photosensitive drum that is forming a toner image may be referred to as a first photosensitive drum, and a photosensitive drum that is increased or decreased in speed so as to reduce load fluctuations may be discriminated as a second photosensitive drum. That is, the first photosensitive drum (first photosensitive member), the second photosensitive drum (second photosensitive member), the third photosensitive drum (third photosensitive member), and the fourth photosensitive drum (fourth photosensitive member) may be roughly classified into two, such as a first photosensitive drum and a second photosensitive drum.

For example, in the foregoing embodiments, at least one of the photosensitive drums 26M, 26C, and 26Bk, whose peripheral speed is to be controlled during image formation while the developing roller 54 is brought into contact with only the photosensitive drum 26Y, can be used as the second photosensitive drum. In this case, the photosensitive drum 26Y corresponds to the first photosensitive drum.

In the foregoing embodiments, at least one of the photosensitive drums 26Y, 26M, and 26C, whose peripheral speed is to be controlled during image formation while the developing roller 54 is brought into contact with only the photosensitive drum 26Bk, can be used as the second photosensitive drum. In this case, the photosensitive drum 26Bk corresponds to the first photosensitive drum.

Also with the six-color-image forming apparatus, as in the above description, it is apparent that a photosensitive drum that is forming a toner image and a photosensitive drum whose speed is to be increased or decreased can be classified as the first photosensitive drum and the second photosensitive drum.

Although the foregoing embodiments are configured such that the peripheral speed of the photosensitive drum is changed to a predetermined value, the invention is not limited thereto; for example, control for changing the peripheral speed step by step in accordance with the profile of load fluctuations.

In the foregoing embodiments, an image forming apparatus is used by way of example which adopts photosensitive drums as image bearing members and adopts an intermediate transfer belt as an intermediate transfer member; however, the invention is not limited thereto. In the case where elastic deformation of the driving system is the main factor, load fluctuations cause the same phenomenon in both of a case where the driven side is a belt and a case where the driven side is drums. For example, the invention may be an image forming apparatus that adopts a photosensitive belt as an image bearing member and adopts an intermediate transfer drum as an intermediate transfer member. In this case, the speed of the photosensitive belt can be corrected by the same speed correction sequence. That is, the foregoing embodiments can be applied to speed control of various photosensitive members.

In the foregoing embodiments, process cartridges that are detachably mounted to an image-forming-apparatus main body are used by way of example, each of which integrally includes a photosensitive drum and a charging member, a developing member, and a cleaning member which serve as processors that act on the photosensitive drum. However, the process cartridges are not limited thereto. It may be process cartridges that each integrally include, in addition to the photosensitive drum, one of the developing member, the developing unit, and the cleaning member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-138047 filed May 27, 2008, and No. 2009-099066 filed Apr. 15, 2009, which are hereby incorporated by reference herein in their entirety.

What is claimed is:

1. A color-image forming apparatus including a plurality of photosensitive members corresponding to individual colors, the photosensitive members being disposed along a moving direction of a transfer member to which images are to be transferred and rotating at a peripheral speed lower than the transfer member, and developers being brought into contact with and separated from the photosensitive members, the individual photosensitive members being brought into contact with the transfer member and the individual developers being brought into contact with the photosensitive members so that toner images are transferred to the transfer member in sequence, thereby performing image formation of an input job, the developers being separated from the photosensitive members along with completion of transfer of the toner images, the color-image forming apparatus comprising:

a control unit configured, during forming of a toner image on the transfer member with a first photosensitive member, to increase the peripheral speed of a second photosensitive member that is not forming the toner image on the transfer member when full color image forming is started or before full color image forming is ended so that a load generated on the transfer member during forming of the toner image on the transfer member with part of the photosensitive members is at least similar in magnitude to a reference load generated between all the photosensitive members and the transfer member while all the photosensitive members, with which the developers are in contact, are forming toner images on the transfer member, wherein the load is at least similar in magnitude to the reference load so as to prevent driving torque fluctuations of the transfer member regardless of whether toner is supplied to a nip portion between the plurality of photosensitive members and the transfer member.

2. The color-image forming apparatus according to claim 1, wherein in image formation for a first page of the input job, the control unit controls the peripheral speed of a photosensitive member that is not forming the toner image on the transfer member while forming the toner image on the transfer member with a photosensitive member disposed in the uppermost stream in the moving direction of the transfer member so that the load is at least similar in magnitude to the reference load, and in image formation for a last page of the input job, the control unit controls the peripheral speed of a photosensitive member that is not forming the toner image on the transfer member while forming the toner image with a photosensitive member disposed in a lowermost stream in the moving direction of the transfer member so that the load is at least similar in magnitude to the reference load.

3. The color-image forming apparatus according to claim 1, further comprising a driving unit configured to drive the transfer member and the lowermost stream photosensitive member, wherein the control unit controls the peripheral speed of a photosensitive member that is disposed at a position other than the lowermost downstream and is not forming a toner image so that the load is at least similar in magnitude to the reference load.

4. The color-image forming apparatus according to claim 1, further comprising a driving unit configured to drive the transfer member and the uppermost stream photosensitive member, wherein the control unit controls the peripheral speed of a photosensitive member that is disposed at a position other than the uppermost upstream and is not forming a toner image so that the load is at least similar in magnitude to the reference load.

5. The color-image forming apparatus according to claim 1, further comprising a cleaning member configured to remove a toner image remaining on the transfer member.

6. A color-image forming apparatus including a plurality of photosensitive members corresponding to individual colors, the photosensitive members being disposed along a moving direction of a transfer member and rotating at a peripheral speed higher than the transfer member, and developers being brought into contact with/separated from the photosensitive members, the individual photosensitive members being brought into contact with the transfer member and the individual developers being brought into contact with the photosensitive members so that toner images are transferred to the transfer member in sequence, thereby performing image formation of an input job, the developers being separated from the photosensitive members along with completion of transfer of the toner images, the color-image forming apparatus comprising:

a control unit configured, during forming of a toner image on the transfer member with a first photosensitive member, to decrease the peripheral speed of a second photosensitive member that is not forming the toner image on the transfer member when full color image forming is started or before full color image forming is ended so that a load generated on the transfer member during forming of the toner image on the transfer member with part of the photosensitive members is at least similar in magnitude to a reference load generated between all the photosensitive members and the transfer member while all the photosensitive members, with which the developers are in contact, are forming toner images on the transfer member, wherein the load is at least similar in magnitude to the reference load so as to prevent driving torque fluctuations of the transfer member regardless of whether toner is supplied to a nip portion between the plurality of photosensitive members and the transfer member.

7. The color-image forming apparatus according to claim 6, wherein in image formation for a first page of the input job, the control unit controls the peripheral speed of a photosensitive member that is not forming the toner image on the transfer member while forming the toner image on the transfer member with a photosensitive member disposed in the uppermost stream in the moving direction of the transfer member so that the load is at least similar in magnitude to the reference load, and in image formation for a last page of the input job, the control unit controls the peripheral speed of a photosensitive member that is not forming the toner image on the transfer member while forming the toner image with a photosensitive member disposed in a lowermost stream in the moving direction of the transfer member so that the load is at least similar in magnitude to the reference load.

8. The color-image forming apparatus according to claim 6, further comprising a driving unit configured to drive the transfer member and the lowermost stream photosensitive member, wherein the control unit controls the peripheral speed of a photosensitive member that is disposed at a position other than the lowermost downstream and is not forming a toner image so that the load is at least similar in magnitude to the reference load.

9. The color-image forming apparatus according to claim 6, further comprising a driving unit configured to drive the transfer member and the uppermost stream photosensitive member, wherein the control unit controls the peripheral speed of a photosensitive member that is disposed at a position other than the uppermost upstream and is not forming a toner image so that the load is at least similar in magnitude to the reference load.

10. The color-image forming apparatus according to claim 6, further comprising a cleaning member configured to remove a toner image remaining on the transfer member.

11. An image forming apparatus comprising:

a plurality of image bearing members configured to bear toner images;

a transfer member in contact with the plurality of image bearing members and to which toner images are transferred from the plurality of image bearing members, wherein a peripheral speed of an image bearing member from which a toner image is being transferred to the transfer member is set to be slower than a peripheral speed of an image bearing member from which the toner image is not being transferred to the transfer member; and a control unit configured, when a toner image formed on a first image bearing member of the plurality of image bearing members is being transferred to the transfer member, to control a peripheral speed of a second image bearing member so that the peripheral speed of the second image bearing member from which the toner image is not being transferred is faster than the peripheral speed of the second image bearing member when the toner image is being transferred from the second image bearing member to the transfer member.

12. The image forming apparatus according to claim 11, wherein toner is not being supplied to a nip portion between the image bearing members and the transfer member when the toner image is not being transferred.

13. The image forming apparatus according to claim 11, further comprising:

a driving unit configured to drive the transfer member and an image bearing member disposed at a most downstream position among the plurality of image bearing members, wherein the control unit controls a peripheral speed of the second image bearing member, which is not the image bearing member disposed at the most downstream position, and from which the toner image is not being transferred.

14. The image forming apparatus according to claim 11, further comprising:

a driving unit configured to drive the transfer member and an image bearing member disposed at a most upstream position among the plurality of image bearing members, wherein the control unit controls a peripheral speed of the second image bearing member, which is not the image bearing member disposed at the most upstream position, and from which the toner image is not being transferred.

15. The image forming apparatus according to claim 11, wherein the control unit controls a peripheral speed of an image bearing member when a color image is being formed by a plurality of image bearing members.

16. An image forming apparatus comprising:

a plurality of image bearing members configured to bear toner images;

a transfer member in contact with the plurality of image bearing members and to which toner images are transferred from the plurality of image bearing members, wherein a peripheral speed of an image bearing member from which a toner image is being transferred to the transfer member is set to be faster than a peripheral speed of an image bearing member from which the toner image is not being transferred to the transfer member; and a control unit configured, when the toner image formed on a first image bearing member of the plurality of image bearing members is being transferred to the transfer member, to control a peripheral speed of a second image bearing member so that the peripheral speed of the second image bearing member from which the toner image is not being transferred is slower than the peripheral speed of the second image bearing member when the toner image is being transferred from the second image bearing member to the transfer member.

17. The image forming apparatus according to claim 16, wherein toner is not being supplied to a nip portion between the image bearing members and the transfer member when the toner image is not being transferred.

18. The image forming apparatus according to claim 16, further comprising:

a driving unit configured to drive the transfer member and an image bearing member disposed at a most downstream position among the plurality of image bearing members, wherein the control unit controls a peripheral speed of the second image bearing member, which is not the image bearing member disposed at the most downstream position, and from which the toner image is not being transferred.

19. The image forming apparatus according to claim 16, further comprising:

a driving unit configured to drive the transfer member and an image bearing member disposed at a most upstream position among the plurality of image bearing members, wherein the control unit controls a peripheral speed of the second image bearing member, which is not the image bearing member disposed at the most upstream position, and from which the toner image is not being transferred.

20. The image forming apparatus according to claim 16, wherein the control unit controls a peripheral speed of an image bearing member when a color image is being formed by a plurality of image bearing members.

* * * * *